US012213630B1

(12) United States Patent
Lei

(10) Patent No.: US 12,213,630 B1
(45) Date of Patent: Feb. 4, 2025

(54) FOLDABLE BATHTUB

(71) Applicant: Bolin Lei, Pu'er (CN)

(72) Inventor: Bolin Lei, Pu'er (CN)

( * ) Notice: Subject to any disclaimer, the term of this patent is extended or adjusted under 35 U.S.C. 154(b) by 0 days.

(21) Appl. No.: 18/901,721

(22) Filed: Sep. 30, 2024

(51) Int. Cl.
*A47K 3/06* (2006.01)

(52) U.S. Cl.
CPC ..... *A47K 3/06* (2013.01)

(58) Field of Classification Search
CPC ..... A47K 3/06
See application file for complete search history.

(56) References Cited

U.S. PATENT DOCUMENTS 3,015,111 A * 1/1962 Parker ..... A47K 3/164 4/585
3,097,367 A * 7/1963 Seivert ..... A47K 3/064 4/585
9,055,847 B1 * 6/2015 Flannery ..... A47C 4/283
2019/0375539 A1 * 12/2019 Mu ..... B65D 7/26
2023/0146681 A1 * 5/2023 Mu ..... A01K 13/001 4/584

* cited by examiner

*Primary Examiner* — Christine J Skubinna
(74) *Attorney, Agent, or Firm* — Birchwood IP

(57) ABSTRACT

A foldable bathtub is provided. The foldable bathtub includes a bathtub body that is formed by a soft packaging layer that is supported by a shaping frame and a supporting frame g through a connector, the shaping frame and the supporting frame are composed of different styles of fixed joints and foldable joints. There are multiple connections between the shaping frame and the supporting frame that can be rotated or folded or rotated and folded at the same time. A user can decompose the bathtub body through reasonable and limited steps, which is convenient for the user to store. When in use, the decomposition steps are only needed to reverse to form the bathtub body, which has a simple folding process.

10 Claims, 30 Drawing Sheets

FOLDABLE BATHTUB

TECHNICAL FIELD

The present disclosure relates to the field of foldable bathtub technologies, and in particular, to a foldable bathtub that can be downwardly folded.

BACKGROUND

A bathtub is a container used for people to take a shower. After pouring hot water into it, people can soak in water and take a shower. However, the existing bathtub containers are usually large in volume and require a lot of space when not in use. Therefore, they are all composed of several supporting frames and cloth covers on the market. When not in use, the bathtub can be made smaller by folding a vertical supporting frame. However, during a folding process, a connecting piece for connecting the supporting frame is usually integrated with the supporting frame or fixed by a screw, which renders the folding process more laborious, and a folding effect is not good. Besides that, a folded bathtub still occupies a large volume, which is not conducive to storage.

A foldable bathtub by splicing is not only laborious to assemble, but also very difficult to disassemble. It requires good explosive force from the wrist to break an interference fit of a connecting structure, which is very unfriendly to users of all ages and females.

Therefore, there is a need for a foldable bathtub, it is easier to fold, has good folding effect, and occupies less space after folded.

SUMMARY

The purpose of the present disclosure is to overcome the shortcomings of the prior art and provide a foldable bathtub that can be downwardly folded. The foldable bathtub has advantages of simple folding process, easy assembly and delivery, and can be unfolded by hand for use without a need for installation, it can be fast assembled and storage, has simple assembly and storage steps, and occupies a small space.

The purpose of the present disclosure is achieved through the following technical solutions.

A foldable bathtub, including a bathtub body, where the bathtub body is provided with a soft packaging layer and a barrel supporting member, the soft packaging layer is connected to the barrel supporting member;

the barrel supporting member can be supported by the soft packaging layer to form a barrel-shaped structure when it is in an unfolded state, and this state is a use state;

when the barrel supporting member is changed from the unfolded state to a folded state, it can be folded together with the soft packaging layer to render the soft packaging layer being changed from the barrel-shaped structure to a blocky structure; this state is a storage state and occupies a small space;

the barrel supporting member is consisted of a shaping frame and a supporting frame; the shaping frame is connected to the supporting frame by a connector; both the shaping frame and the supporting frame are formed by splicing a support rod and the connector; the connector can form the shaping frame and the supporting frame and also serve as a connection member between the two, thereby achieving an effect of multifunction;

the connector can be rotated on the shaping frame, that is, the supporting frame can be flipped by changing an angle between it with the shaping frame through the connector, thereby facilitating storage and being simple to store; a limit piece is provided between the connector and the support rod, the limit piece can prevent the connector from being detached from the support rod during rotation or use, thus, the bathtub body can be repeatedly folded/activated and is not easily damaged;

the connector includes a fixed joint and a foldable joint; the fixed joint is configured to connect the support rod when there is no displacement so as to further improve fastening; the foldable joint is used when there is a folding so as to ensure fastening and allows the barrel supporting member to be smoothly flipped for easily stored by a user;

at least one pair of foldable joints are provided at a connection between the shaping frame and the supporting frame, thereby allowing the shaping frame to be folded, and the supporting frame can be attached to the shaping frame, while the remaining are the fixed joint;

the supporting frame is provided with an inclined support rod, thereby forming a triangular structure in the supporting frame; by utilizing a stability principle of triangles, a single support rod only faces one angle, and a length of the support rod determines an opening (i.e. size) of the angle; this structural characteristic allows the supporting frame to maintain its shape and size unchanged when subjected to a force, thus possessing characteristics of stability, firmness, and pressure resistance;

where the supporting frame can also cooperate with the support rod through the foldable joint and the fixed joint to form the supporting frame with a folding effect, that is, both the shaping frame and the supporting frame can be folded, thereby further reducing a cross-section of the bathtub body after being folded.

In an embodiment, a top of the soft packaging layer is provided with an inflatable ring for the user to lean on; an outermost layer of the soft packaging layer is a shaping layer, which has an anti-stretching effect and prevents a deformation of the bathtub body; an innermost layer of the soft packaging layer that is contacted with a human body is a waterproof layer, and a thermal insulation layer is provided between the shaping layer and the waterproof layer to delay temperature loss; the soft packaging layer is protruded from the shaping frame, and a protruding portion thereof can be flipped outwardly to cover the shaping frame and form a sleeve that can be sleeved into the shaping frame, which can form a stable connection and facilitate deformation together with the shaping frame; the shaping layer is further provided a tightening rod layer configured for a side support rod to penetrate, and through a cooperation between the side support rod and the supporting frame, a side wall of the bathtub body is maintained in the unfolded state and not easily deformed; upper and lower ends of the tightening rod layer are provided with an insertion hole, the side support rod is connected to the shaping frame after penetrating the tightening rod layer, the side rod can also be rotated around the shaping frame, which means that the side rod can be folded and stored.

In an embodiment, the limit piece is composed of a protruding column and a limiting groove, the protruding column is provided on the support rod, a spring is provided at a bottom of the protruding column; the spring can render the protruding column to be protruded from the support rod when not subjected to an external force and can be clamped into the limiting groove; the limiting groove includes a hole groove and an arc-shaped groove; the hole groove can fasten the support rod to render it have no deviate; and the arc-shaped groove can prevent the support rod from being detached from the connector; at the same time, when the connector and the support rod are rotated, the arc-shaped groove is a space to avoid the protruding column; a side wall of the limiting groove is tilted outwardly, and two ends of the support rod are provided with the protruding column; the protruding column on one end of the support rod is placed into the hole groove.

In an embodiment, the foldable joint is composed of two connection rod seats connected by a folding piece, and the folding effect of the foldable joint is achieved through the folding piece; each of the two connection rod seats is provided with at least one limiting groove and one rod inlet, the folding piece is provided with an embedding piece and a clamping piece; the embedding piece and the clamping piece are provided with connection holes that are located on the same straight line; the embedding piece can be inserted into the clamping piece; when the embedding piece is provided on one of the two connection rod seats, the clamping piece is provided on the other one of the two connection rod seats; the connection hole can be inserted with a bolt to lock the embedding piece and the clamping piece, so that they can only be folded and cannot be moved longitudinally.

In an embodiment, the fixed joint includes a T-shaped joints, a butterfly-shaped joint, and an angled joint; different shapes of fixed joints are used to connect different parts to ensure a connection stability and reduce a space occupied by the fixed joint; the three joints are all provided with at least two rod inlets and at least two limiting grooves; the limiting grooves can be selected as hole groove/arc-shaped groove according to an actual need; the T-shaped joint and the butterfly-shaped joint can be used on the shaping frame to form the shaping frame, the rod inlet is provided at lower ends of the T-shaped joint and the butterfly-shaped joint is configured to connect the side support rod or the supporting frame; an angle between the rod inlets that are provided on the angled joint is smaller than 30°, and the angled joint is used to connect the support rod at a lower side of the supporting frame and the support rod that is titled in the supporting frame.

In an embodiment, the foldable joint includes a straight flipping head, a T-shaped flipping head, and a disc-shaped flipping head; an appropriate foldable joint is selected according to the number and structure of the support rod that are needed to be folded to ensure the reasonable occurrence of folding and enable the user to quickly fold/activate; the straight flipping head is provided with two rod inlets located on the same straight line, thereby supporting a folding of the two support rods in a straight state; the T-shaped flipping head has the same appearance as the T-shaped joint, the folding piece is offset to one side so as to avoid the rod inlet located below, thereby preventing a lower support rod from being detached when a folding occurs; the T-shaped flipping head supports a right angle structure composed of two vertical support rods and another support rod connected to the T-shaped flipping head for folding, that is, a horizontal support rod on one side of the T-shaped structure is folded; the disc-shaped flipping head has the same appearance as the butterfly-shaped joint, and the flipping piece is provided in a middle of the disc-shaped flipping head; one side of the disc-shaped flipping head can be connected to a horizontal support rod and an inclined support rod, and the two support rods form a sharp angle structure; the disc-shaped flipping head can form a two-sharp angle-structure that can form a mirror image and be flipped along a symmetry axis; where the horizontal support rod is located on the shaping frame, and the inclined support rod is located on the supporting frame, so that the shaping frame can be stored a triangular structure of the supporting frame that can be folded; a reinforcement rib is provided between the two connection rod seats provided on the straight flipping head, the T-shaped flipping head, and the disc-shaped flipping head.

In an embodiment, the shaping frame is formed by inserting an arc-shaped rod and a straight rod into the connector, thereby forming a capsule shape with a hollow middle to form a barrel mouth of the bathtub body; there are two arc-shaped rods, and they are provided on two sides of the straight rod; the supporting frame is formed by placing a plurality of straight rods into the connector; the straight rods on an outside of the supporting frame form a shape of "⊔", two straight rods in the supporting frame are inclined to each other so as to form a triangular structure; bottom ends of the two side rods are inclined inwardly.

In an embodiment, the disc-shaped flipping head is provided in a middle of the shaping frame, two sides of the disc-shaped flipping head are both connected with the straight rod; one end of the straight rod away from the disc-shaped flipping head is connected to the arc-shaped rod through the T-shaped joint; a middle of the arc-shaped rod is provided with the T-shaped joint connecting the side support rod; the straight flipping head is further provided at a lower end of the supporting frame and a corresponding position of the disc-shaped flipping head;

where the arc-shaped groove is provided at upper ends of the disc-shaped flipping head and the T-shaped joint, and the remaining limiting grooves are all hole grooves.

In an embodiment, the butterfly-shaped joints are symmetrically provided in a middle of the shaping frame, the straight rod is provided on two sides of the butterfly-shaped joint; one end of the straight rod away from the butterfly-shaped joint is connected to the arc-shaped rod through the T-shaped flipping head, the T-shaped joint connecting the side support rod is provided in the middle of the arc-shaped rod;

where the arc-shaped groove is provided at upper ends of the butterfly-shaped joint, the T-shaped flipping head, and the T-shaped joint, while the remaining limiting grooves are all hole grooves.

In an embodiment, the disc-shaped flipping heads are symmetrically provided in a middle of the shaping frame, the straight rod is provided at two sides of the disc-shaped flipping head; one end of the straight rod away from the disc-shaped flipping head is connected to the arc-shaped rod through the T-shaped flipping head; the T-shaped joint connecting the side support rod is provided in the middle of the arc-shaped rod; the straight flipping head is further provided at a lower end of the supporting frame and a corresponding position of the disc-shaped flipping head;

where the arc-shaped groove is provided at upper ends of the disc-shaped flipping head, the T-shaped flipping head, and the T-shaped joint, and the remaining limiting grooves are all hole grooves.

Beneficial effects of the present disclosure:

1. in terms of performance:

(1) after assembly, it can be shipped without a need for installation, and can be quickly activated upon arrival, this process is simple and easy to use;

(2) it can be folded multiple times to transform the bathtub body from a barrel-shaped structure to a blocky structure, rendering it easy to store;

(3) adopting a multi-layer structure, a side wall of the bathtub has an effect of tensile resistance and insulation;

(4) a plug-in clamp connection is easy production and installation;

(5) the style of the connector can be adjusted according to an actual need to combine different folding ways of the bathtub body.

2. in terms of the structural:

(1) providing with the barrel supporting member ensures a structural stability during forming a barrel;

(2) providing with different styles of fixed joints and foldable joints ensures a smooth rotation and folding of a part that needs to be rotated and folded and firmly locks the part that cannot be moved;

(3) the soft packaging layer is provided with a sleeve and a tightening rod layer to ensure a firm connection between the soft packaging layer and the barrel supporting member, and thereby ensuring that the barrel supporting member can be folded along with the soft packaging layer.

BRIEF DESCRIPTION OF DRAWINGS

In order to provide a clearer explanation of the technical solution of the embodiments of the present disclosure, a brief introduction will be given below to the accompanying drawings required for use in the embodiments. It should be understood that the following drawings only illustrate some embodiments of the present disclosure and should not be considered as limiting the scope. For those skilled in the art, other relevant drawings can be obtained based on these drawings without creative work.

Figure 1:
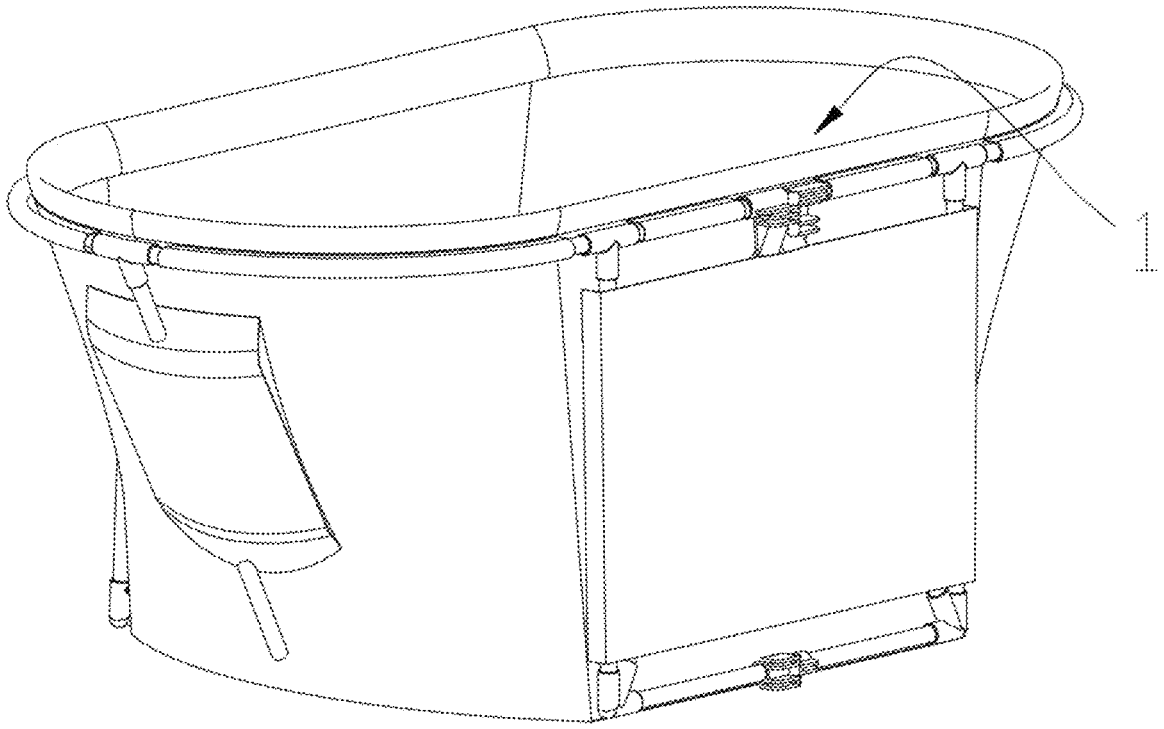
FIG. 1 is a first schematic structural diagram of the present disclosure.
Figure 2:
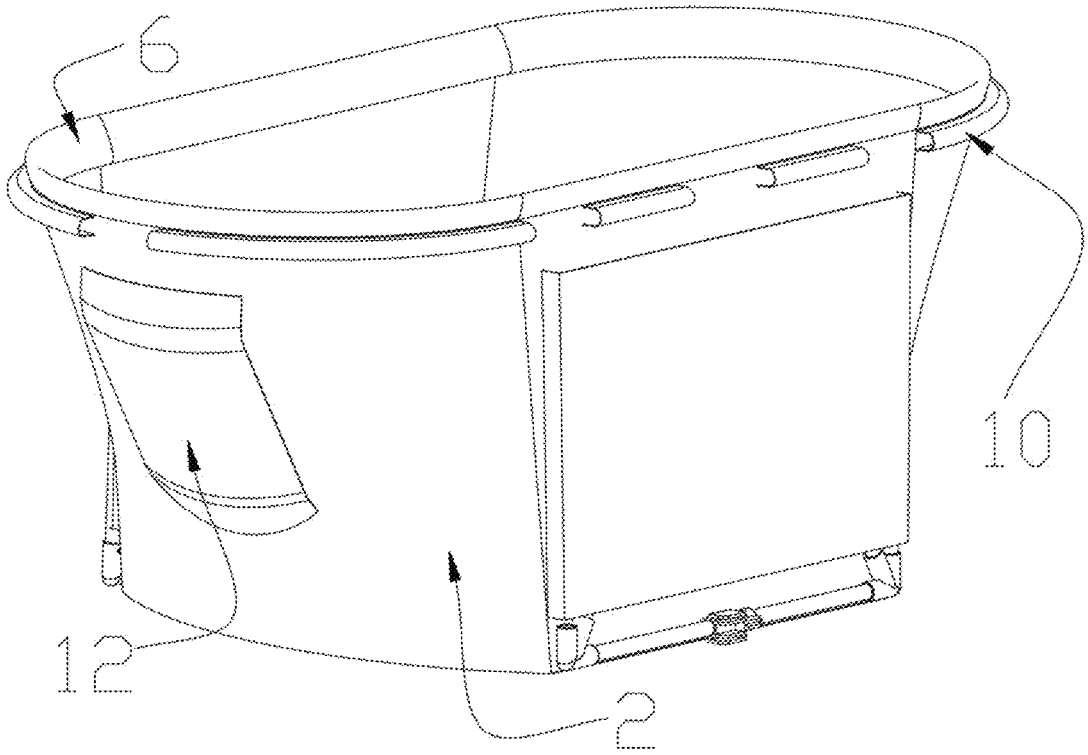
FIG. 2 is a second schematic structural diagram of the present disclosure.
Figure 3:
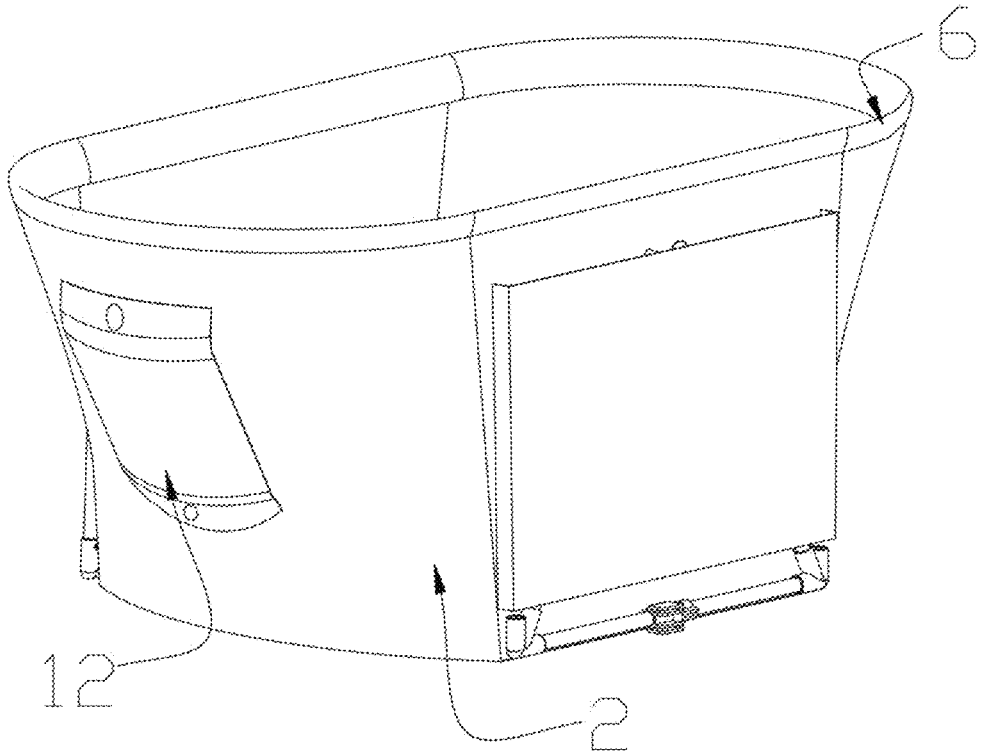
FIG. 3 is a schematic structural diagram of a soft packaging layer of the present disclosure.
Figure 4:
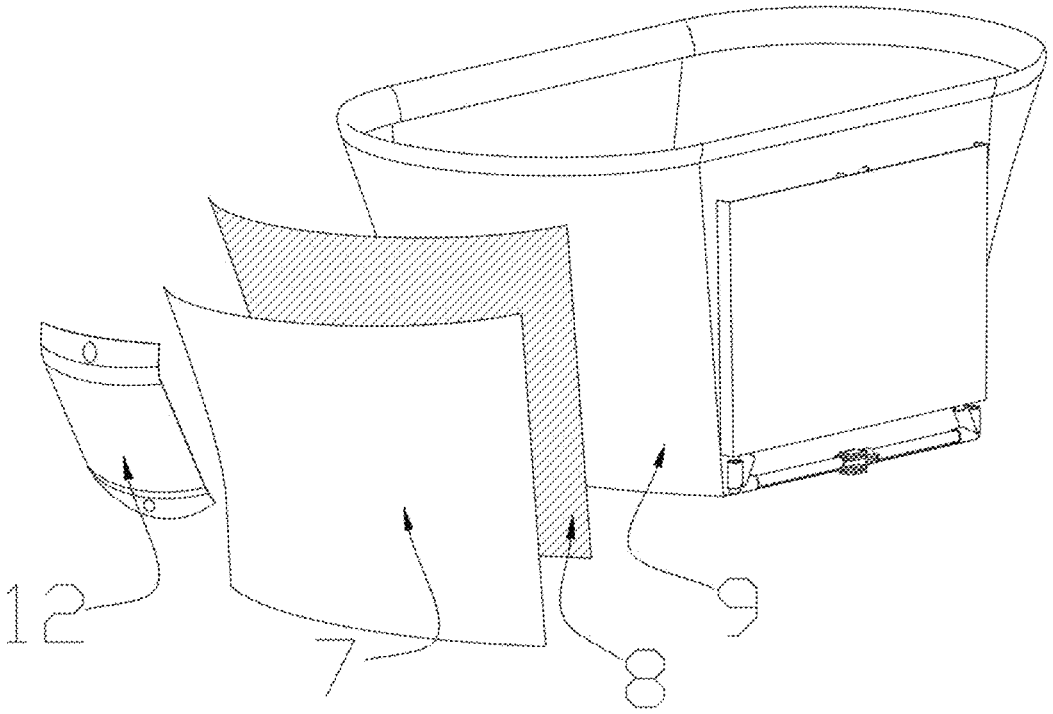
FIG. 4 is an exploded structural diagram of the soft packaging layer of the present disclosure.
Figure 5:
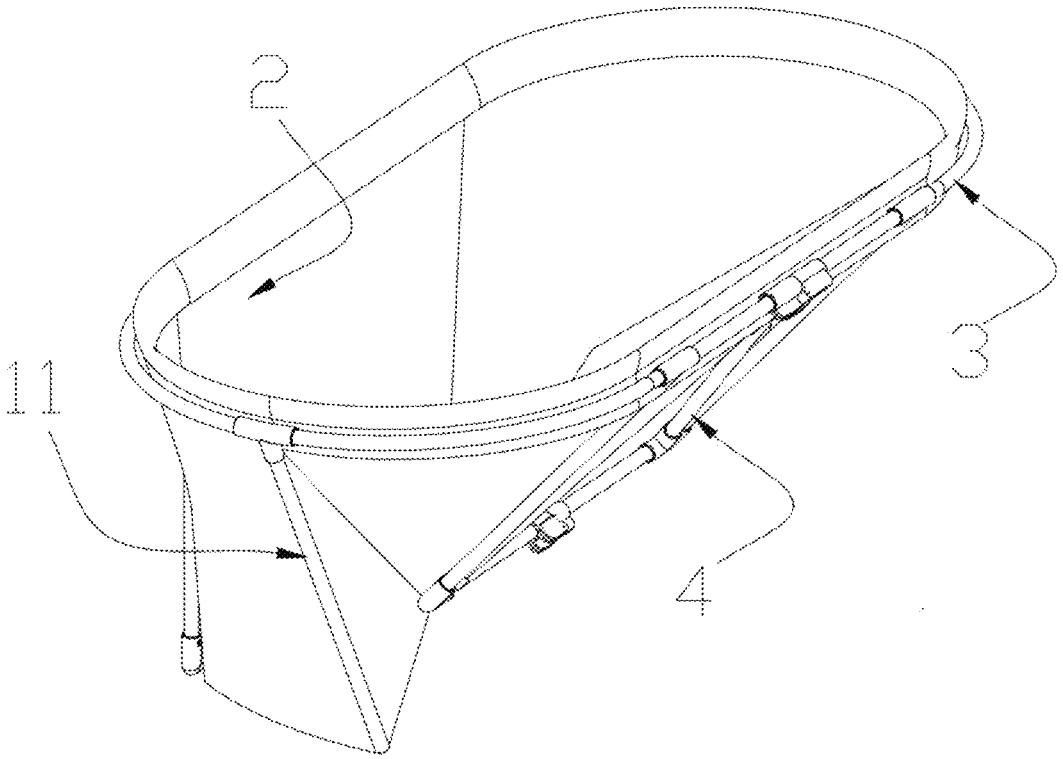
FIG. 5 shows a folding process of a bathtub body of the present disclosure.
Figure 6:
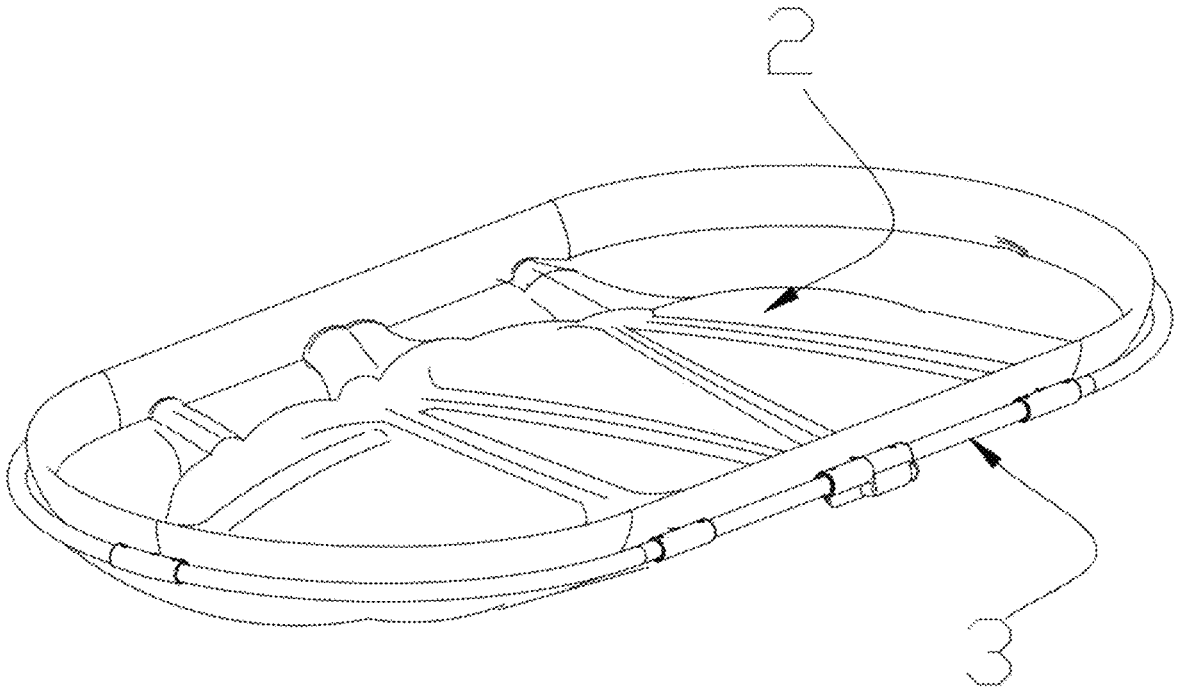
FIG. 6 is a folded state diagram of the bathtub body of the present disclosure.
Figure 7:
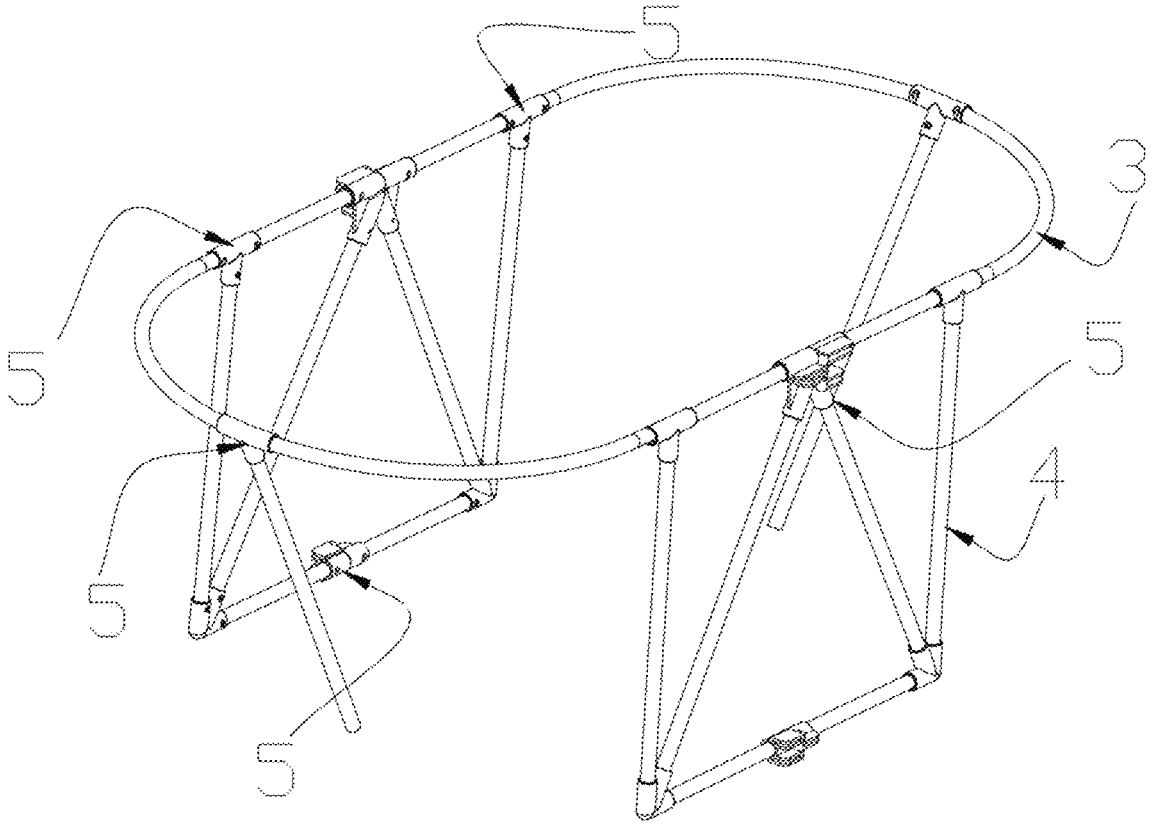
FIG. 7 is a schematic structural diagram of a barrel supporting member of the present disclosure.
Figure 8:
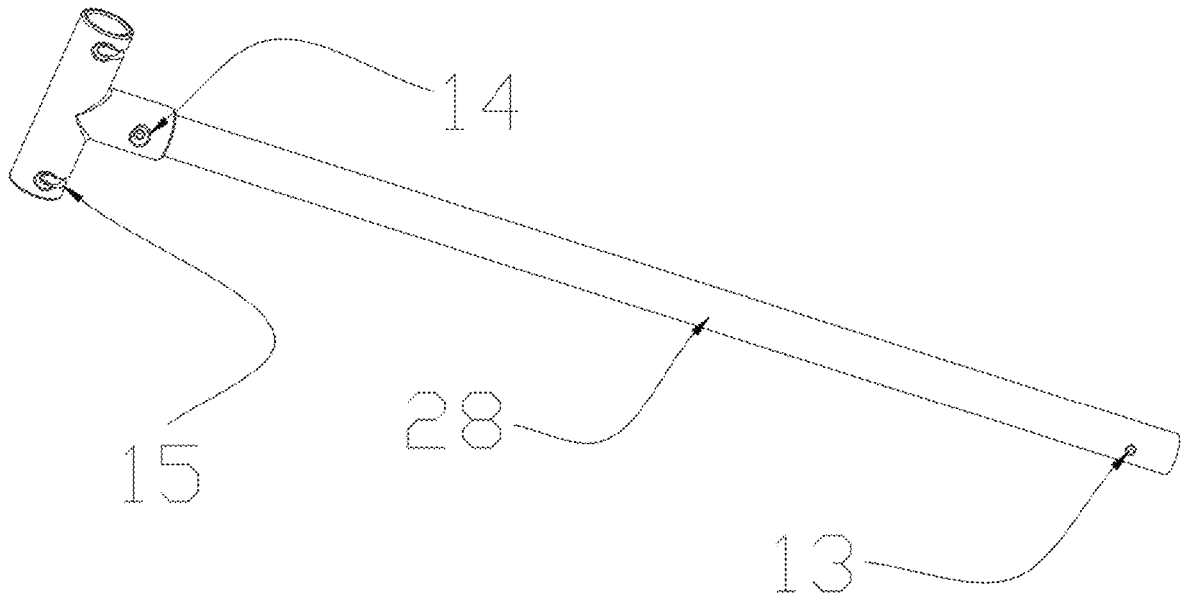
FIG. 8 is a first schematic structural diagram of a limiting groove of the present disclosure.
Figure 9:
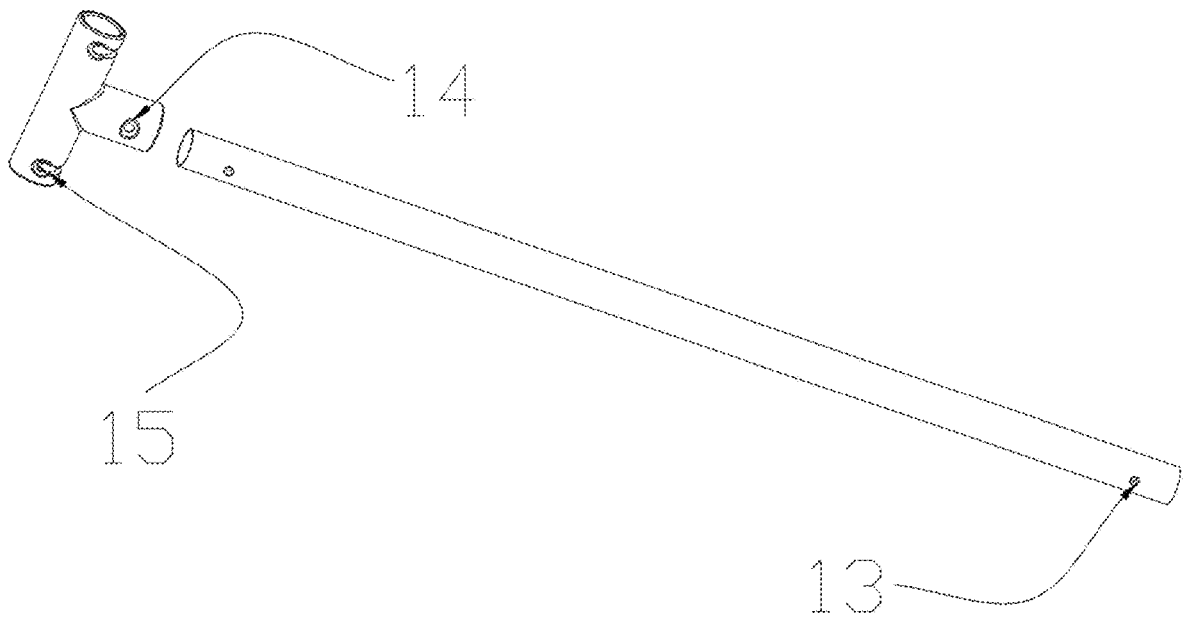
FIG. 9 is a second structural schematic diagram of the limiting groove of the present disclosure.
Figure 10:
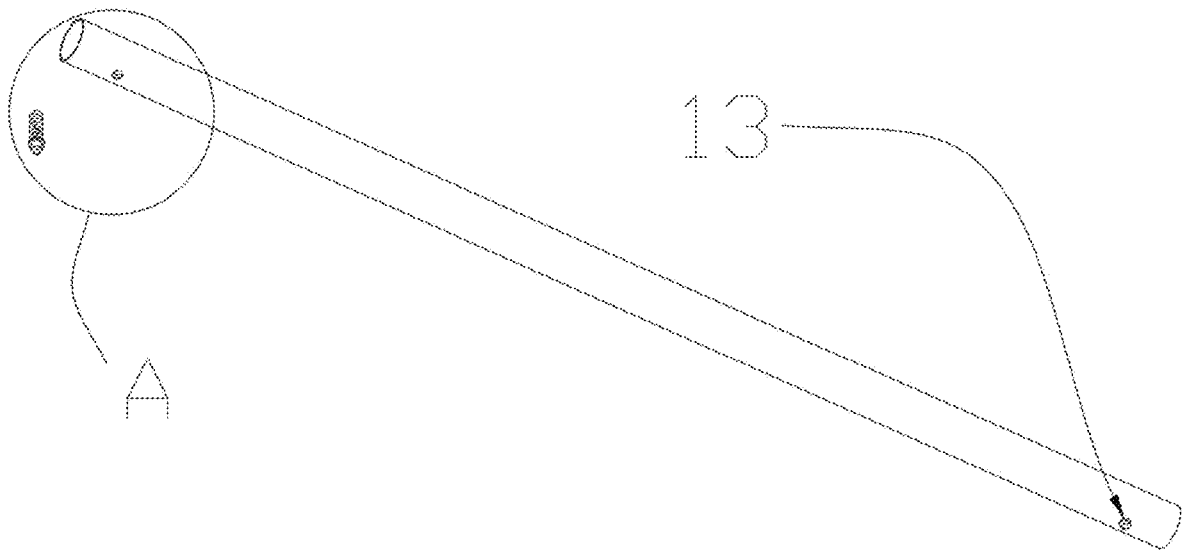
FIG. 10 is a third schematic structural diagram of the limiting groove of the present disclosure.
Figure 11:
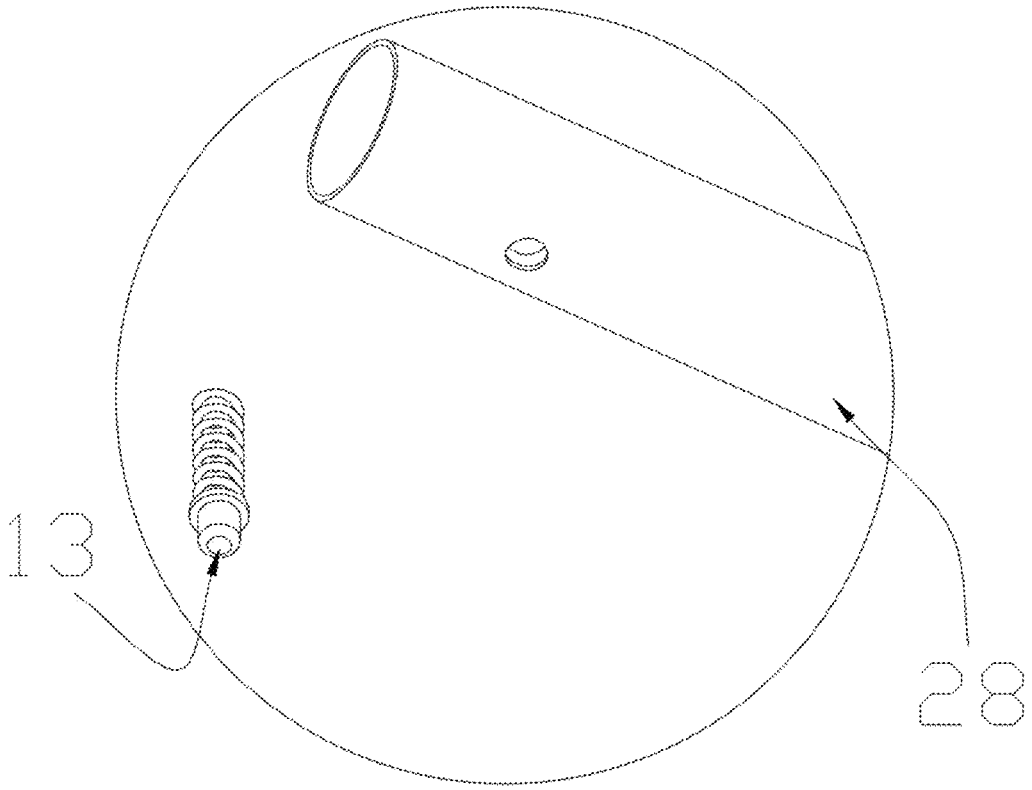
FIG. 11 is an enlarged view of point A in FIG. 10 of the present disclosure.

Numeral reference: bathtub body 1, soft packaging layer 2, shaping frame 3, supporting frame 4, connector 5, inflatable ring 6, shaping layer 7, thermal insulation layer 8, waterproof layer 9, sleeve 10, side support rod 11, tightening rod layer 12, protruding column 13, hole groove 14, arc-shaped groove 15, connection rod seat 16, rod inlet 17, embedding piece 18, clamping piece 19, connection hole 20, T-shaped joint 21, butterfly-shaped joint 22, angled joint 23, straight flipping head 24, T-shaped flipping head 25, disc-shaped flipping head 26, arc-shaped rod 27, straight rod 28, reinforcement rib 29.

DESCRIPTION OF EMBODIMENTS

In the following description, only some exemplary embodiments are briefly described. As recognized by those skilled in the art, the described embodiments can be modified in various ways without departing from the spirit or scope of the present disclosure. Therefore, the drawings and descriptions are considered to be exemplary rather than limiting the present application.

In a description of the present disclosure, it should be understood that terms "up", "down", "front", "back", "left", "right", "top", "bottom", "inside", "outside" and other directional or positional relationships indicated are based on a directional or positional relationships shown in the accompanying drawings, only for a convenience of describing the present disclosure and simplifying the description, and do not indicate or imply that the device or element referred to must have a specific orientation, be constructed and operated in a specific orientation, and therefore cannot be understood as a limitation of the present disclosure.

In addition, terms "first" and "second" are only used for a descriptive purpose and cannot be understood as indicating or implying a relative importance or implying the number of technical features indicated. Thus, the features limited to "first" and "second" may explicitly or implicitly include one or more of these features. In the description of the present disclosure, "a plurality of" means two or more, unless otherwise specifically limited.

In the present disclosure, unless otherwise specified and limited, terms "installation", "connection to", "connection with", "fixation", etc. should be broadly understood, for example, it can be a fixed connection, a detachable connection, or an integrate connection; it can be a mechanical connection, an electrical connection, or a communication; it can be directly connected or indirectly connected through an intermediate medium, and it can be a connection within two components or an interaction relationship between two components. For those skilled in the art, specific meanings of the above terms in the present disclosure can be understood according to a specific situation.

Below, the embodiments of the present disclosure will be described in detail with reference to the accompanying drawings.

Please refer to FIGS. 1-7: a foldable bathtub that can be downwardly folded in an embodiment is provided, which includes a bathtub body 1, where the bathtub body 1 is provided with a soft packaging layer 2 and a barrel supporting member; the soft packaging layer 2 is connected to the barrel supporting member, and the connection is interlocked;

the barrel supporting member can be supported by the soft packaging layer 2 so as to form a barrel-shaped structure when it is in an unfolded state;

when the barrel supporting member is transformed from the unfolded state to a folded state, it can be folded together with the soft packaging layer 2, the soft packaging layer 2 is caused to transform from the barrel-shaped structure to a blocky structure; according to an actual need, the barrel supporting member can be folded at least once, and an area occupied by the bathtub body can be reduced by a half after each folding;

the barrel supporting member is consisted of a shaping frame 3 and a supporting frame 4, both of which can be folded; the shaping frame 3 and the supporting frame 4 are connected by a connector 5, both the shaping frame 3 and the supporting frame 4 are formed by splicing a support rod and the connector 5, that is, the connector connecting the two is multi-purpose;

the connector 5 can be rotated on the shaping frame 3, that is, the supporting frame 4 can be flipped by changing an angle between it with the shaping frame 3 through the connector 5 so as to achieve a flipping effect; when flipping, the supporting frame 4 is flipped inwardly, and both sides thereof cannot be flipped at the same time; after flipping, one side of the supporting frame 4 is located between an angle formed by the other side of the supporting frame 4 with the shaping frame 3, and is clamped by the two; a side wall of the bathtub body 1 will be adhered to a bottom wall of the bathtub body 1 with the flipping of the supporting frame 4, and the other side of the supporting frame 4 can be pulled inwardly and be tilted inwardly by the bottom wall; that is, only one side wall of the bathtub body 1 needs to be flipped inwardly to release a use state of the bathtub body 1; when in the storage state, a limit piece is further provided between the connector 5 and a support rod, which can prevent the connector 5 from being detached from the support rod during rotation or moving; at the same time, the limit piece can also restrict an angle that the connector 5 can be rotated;

the connector 5 includes a fixed joint and a foldable joint; according to an actual need, an assembly scheme can be adjusted to achieve different folding schemes;

at least one pair of foldable joints are provided at a connection between the shaping frame 3 and the supporting frame 4, so that the shaping frame can be folded, and the remaining are the fixed joint; that is, after the supporting frame 4 has finished the flipping, the bathtub body 1 can be changed from the use state to the storage state; a flat bathtub body 1 can also be folded once through the foldable joint, rendering the bathtub body 1 be folded once in the storage state, which can further reduce an area of the bathtub body 1 in the storage state;

the supporting frame 4 is provided with an inclined support rod, thereby forming a triangular structure in the supporting frame 4; when in use, the triangular structure can firmly support a horizontal bar in a middle of the shaping frame 3; while maintaining a stability of the bathtub body 1 in use, it can also provide a user with an area to place arms, thereby improving comfort.

Where, the supporting frame 4 can also cooperate with the support rod through the foldable joint and the fixed joint to form the supporting frame 4 having a folding effect, that is, the supporting frame 4 can be folded together with the shaping frame 3, and folding directions of the two are consistence, folding two parts can be completed in one go.

As shown in FIGS. 2 to 6, a top of the soft packaging layer 2 is provided with an inflation ring 6, which is provided with an inflation-and-deflation valve; an outermost layer of the soft packaging layer 2 is a shaping layer 7, an innermost layer of the soft packaging layer 2 that is in contact with a human body is a waterproof layer 9, a thermal insulation layer 8 is provided between the shaping layer 7 and the waterproof layer 9; the soft packaging layer 2 is protruded from the shaping frame 3, and a protruding portion of the soft packaging layer 2 can be flipped outwardly to wrap the shaping frame 3 so as to form a sleeve 10 that can be sleeved into the shaping frame 3; the shaping layer 7 is further provided with a tightening rod layer 12 configured for a side support rod 11 to penetrate; upper and lower ends of the tightening rod layer 12 are provided with an insertion hole, the side support rod 11 is connected with the shaping frame 3 after penetrating the tightening rod layer 12; when in use, the shaping layer 7 can counteract a water pressure and an expansion force formed by the human body on the bathtub body 1; the soft packaging layer 2 is connected to the barrel supporting member through the sleeve 10, thereby realizing that the soft packaging layer 2 being folded or unfolded driven by the barrel supporting member. When in use, the sleeve 10 can ensure a stable connection between the soft packaging layer 2 and the barrel supporting member, thereby transmitting a pressure to the barrel supporting member. The tightening rod layer 12 can wrap the side support rod 11, so that the side support rod is supported by a connection point between the ground and the shaping frame 3, and a side wall where the tightening rod layer 12 is located can be tightened so as to prevent a deformation of the bathtub body 1.

As shown in FIGS. 8 to 11, the limit piece includes a protruding column 13 and a limiting groove. The protruding column 13 is provided on the support rod, a spring is provided at a bottom of the protruding column 13. The spring can render the protruding column 13 to be protruded from the support rod when it is not subjected to an external force. When installing/disassembling, the protruding column 13 needs to be pressed into/out of the limiting groove. The installation/separation steps can effectively prevent an accidental contact. The limiting groove includes a hole groove 14 and an arc-shaped groove 15. The hole groove 14 can fasten the support rod to prevent it from deviating, and the arc-shaped groove 15 can prevent the support rod from being detached from the connector 5. At the same time, when the connector 5 is rotated with the support rod, the arc-shaped groove 15 is a space to avoid the protruding column 13. A side wall of the limiting groove is inclined outwardly, this is, an inclined space makes it easier for the user to press down on the protruding column 13 when disassembling. The protruding column 13 is provided at upper and lower ends of the support rod, and the spring is provided in the support rod. When one end of the support rod is placed at the arc-shaped groove 15, the other end thereof should be placed into the connector 5 that is provided with the hole groove 14.

Figure 12:
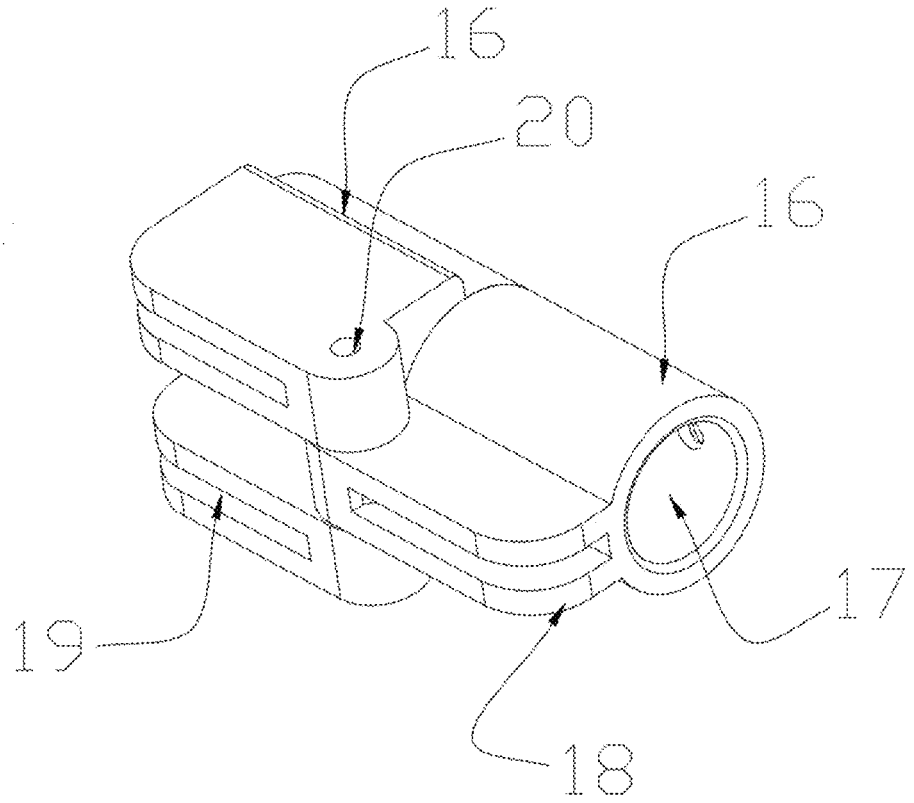
FIG. 12 is a schematic structural diagram of a straight flipping head of the present disclosure.
Figure 13:
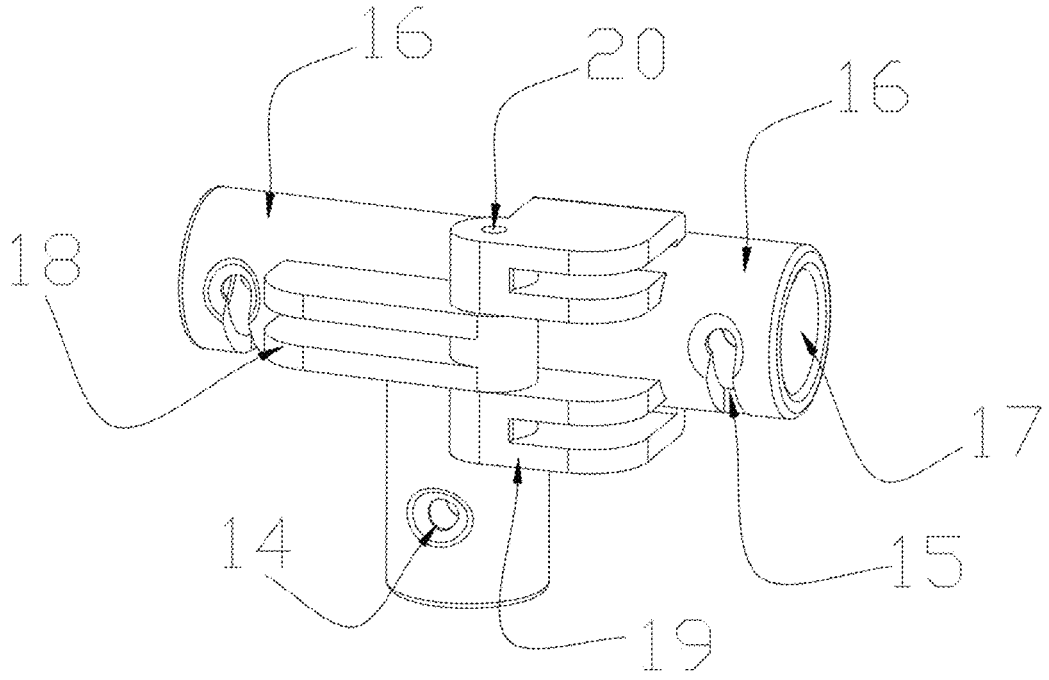
FIG. 13 is a schematic structural diagram of a T-shaped flipping head of the present disclosure.
Figure 14:
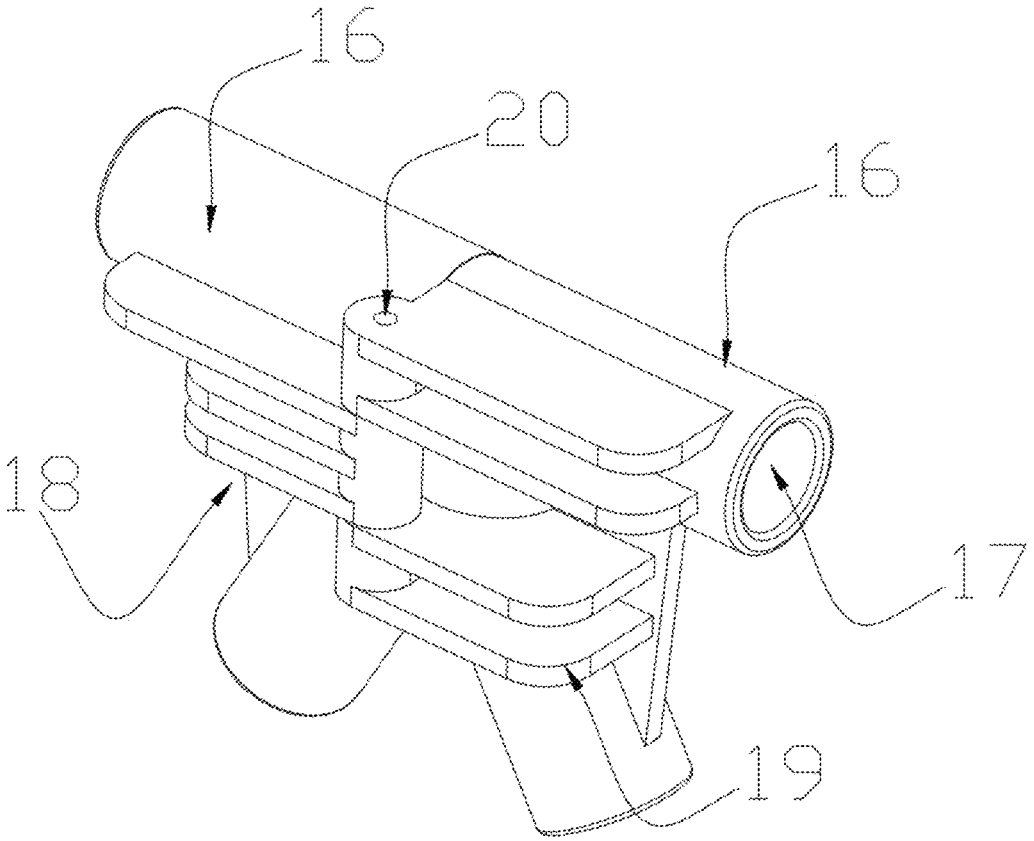
FIG. 14 is a schematic structural diagram of a disc-shaped flipping head of the present disclosure.

As shown in FIGS. 12 to 14; the foldable joint is composed of two connection rod seats 16 connected by a folding piece. Each of the two connection rod seats 16 is provided with at least one limiting groove and one rod inlet 17, so that the support rods installed on different sides of the same foldable joint can be flipped relative to each other. The folding piece is provided with an embedding piece 18 and a clamping piece 19, which are provided with connection holes 20 located on the same straight line. The embedding piece 18 can be placed into the clamping piece 19. The embedding piece 18 is provided on one of the two connection rod seats 16, and the clamping piece 19 is provided on the other one of the two connection rod seats 16. During installation, the embedding piece 18 is placed into the clamping piece 19, and the connection holes 20 provided on the two are rendered to be at the same line, locking a bolt can achieve a connection of the two connection rod seats 16. When a folding occurs, the two connection rod seats 16 are folded along an axis of the connection hole 20.

Figure 15:
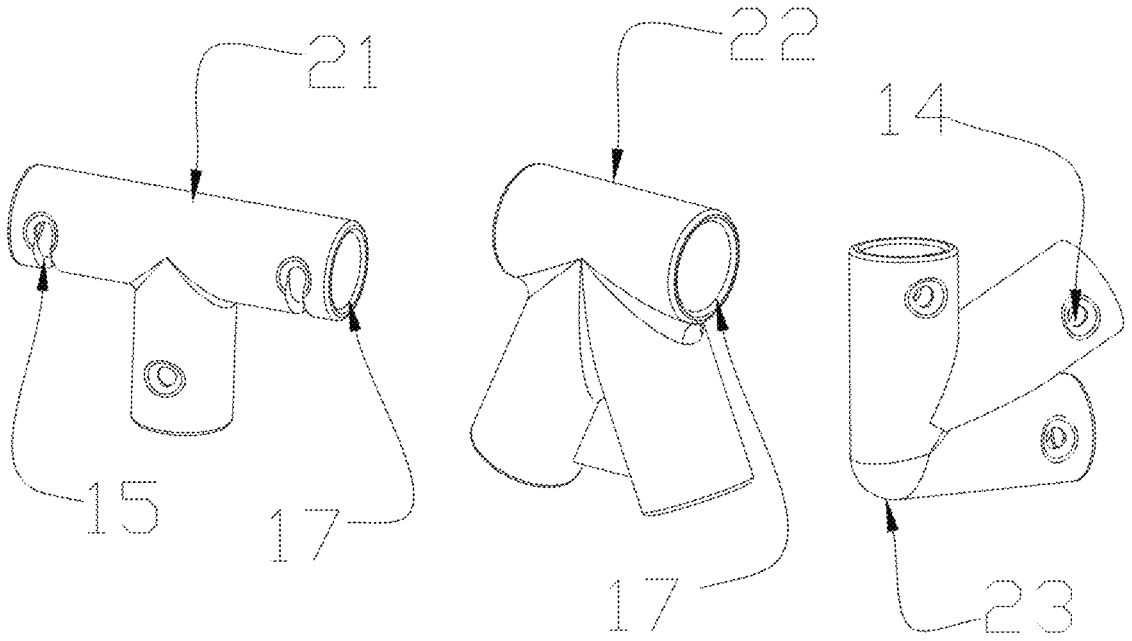
FIG. 15 shows the types of fixed joints in the present disclosure.

As shown in FIG. 15; the fixed joint includes a T-shaped joint 21, a butterfly-shaped joint 22, and an angled joint 23, all of which are provided with at least two rod inlets 17 and at least two limiting grooves. The T-shaped joint 21 and the butterfly-shaped joint 22 can be used on the shaping frame 3 to form the shaping frame 3; the rod inlet 17 provided at lower ends of the T-shaped joint and the butterfly-shaped joint is configured to connect the side support rod 11 or the supporting frame 4; an angle between the rod inlets 17 provided on the angled joint 23 does not exceed 30°, and there are two kinds of T-shaped joint 21;

where, if an upper end of the T-shaped joint 21 is straight, it is used to connect the supporting frame 4; the supporting frame 4 needs to be folded, and to ensure a stability of the supporting frame 4, a folding of the supporting frame 4 is actually that the T-shaped joint 21 is rotated on the shaping frame 3; and thus, the limiting groove provided at a rear of the rod inlet 17 that is provided on left and right sides of the T-shaped joint 21 is the arc-shaped groove 15, and the limiting groove at a bottom for connecting the supporting frame 4 is the hole groove 14;

if the upper end of the T-shaped joint 21 is arc-shaped, then it is provided at front and rear ends of the shaping frame 3 to connect the side support rod 11; in order to further stabilize the side support rod 11, the limiting groove provided at a bottom of the arc-shaped T-shaped joint 21 is the hole groove 14 to achieve a storage of the support rod at one side, the hole groove provided at two sides of the arc-shaped T-shaped joint 21 is the arc-shaped groove 15;

when the butterfly-shaped joint 22 is provided in the middle of the shaping frame 3, it can be rotated; thus, the limiting groove provided at an upper end of the butterfly-shaped joint 22 is the arc-shaped groove 15, and a lower end of the butterfly-shaped joint 22 that is connected to is an inclined support rod that forms a triangular structure; to ensure a stability of the triangular structure, the limiting groove provided at a lower end of the butterfly-shaped joint 22 is the hole groove 14;

the angled joint 23 is provided at a bottom of the supporting frame 4; in order to stabilize a triangular mechanism formed by the entire supporting frame 4, all the limiting grooves on the angled joint 23 are the hole groove 14.

Figure 16:
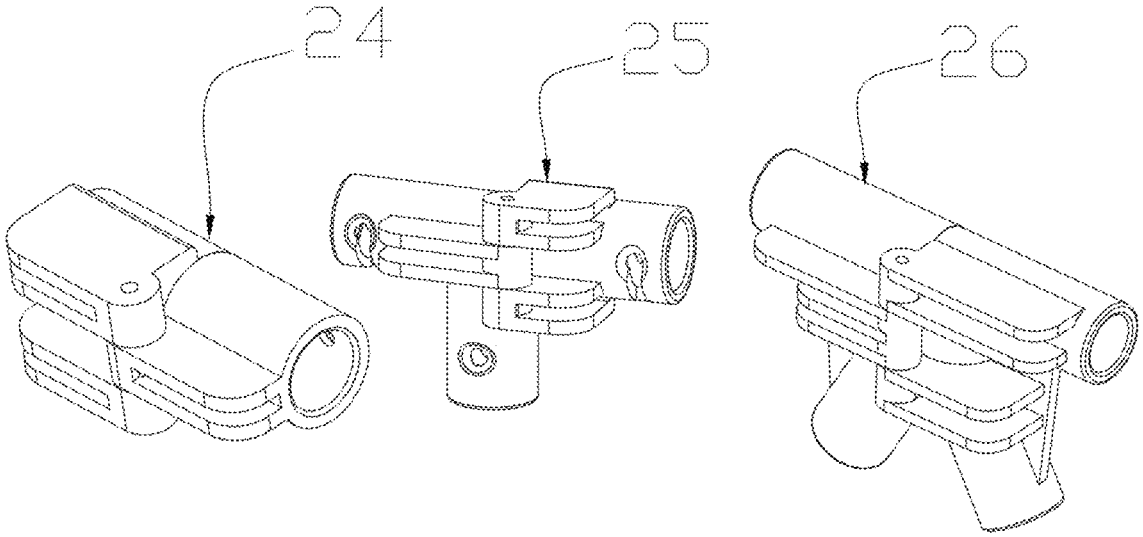
FIG. 16 shows the types of foldable joints in the present disclosure.

As shown in FIG. 16; the foldable joint includes a straight flipping head 24, a T-shaped flipping head 25, and a disc-shaped flipping head 26;

the straight flipping head 24 is provided with two rod inlets 17 located on the same straight line; the straight flipping head 24 is configured to flip the two support rods that are distributed in a straight line, thereby forming a cooperation with the disc-shaped flipping head 26, so that the supporting frame 4 has the folding effect; the straight flipping head 24 is provided at a bottom of the support rod so as to ensure the stability of the supporting frame 4; the limiting grooves provided on two sides of the straight flipping head 24 are the hole groove 14;

the T-shaped flipping head 25 has the same appearance as the T-shaped joint 21, and a position of the flip piece is offset to one side so as to avoid the rod inlet 17 located below; specifically, the T-shaped joint 21 is composed of two connection rod seats 16;

one of the two connection rod seats 16 is a combination of the rod inlet 17 provided at a bottom of the T-shaped joint 21 and the rod inlet 17 provided at one side of the T-shaped joint 21, specifically a right-angled bent pipe structure is formed as a whole; the rod inlet 17 located at a lower is configured to connect the supporting frame 4, so the limiting groove that is provided is the hole groove 14; the rod inlet 17 provided at an upper is connected to the shaping frame 3 and is designed for rotation, so the limiting groove that is provided is the arc-shaped groove 15; in order to reduce weight and space occupation, the connection rod seat 16 described herein is provided with the embedding piece 18;

the other one of the two connection rod seats 16 only has one rod inlet 17 at one side, which is connected to the shaping frame 3; in order to facilitate rotation, the limiting groove that is provided is the arc-shaped groove 15; due to its relatively simple structure, the clamping piece 19 is provided to strengthen a counterweight and structural strength of the connection rod seat 16 described herein;

the disc-shaped flipping head 26 has the same appearance as the butterfly-shaped joint 22, and the folding piece is provided in a middle of the disc-shaped flipping head 26; lower ends of the disc-shaped flipping head 26 and the butterfly-shaped joint 22 are both provided with a reinforcement rib in block-shaped to further enhance the stability of the supporting frame 4 after combination; when the folding occurs, the disc-shaped flipping head 26 is folded along a centerline, and the disc-shaped flipping head 26 is located exactly in the middle of the shaping frame 3, which can ensure that an overall weight distribution of the bathtub body 1 is uniform after folding.

Figure 17:
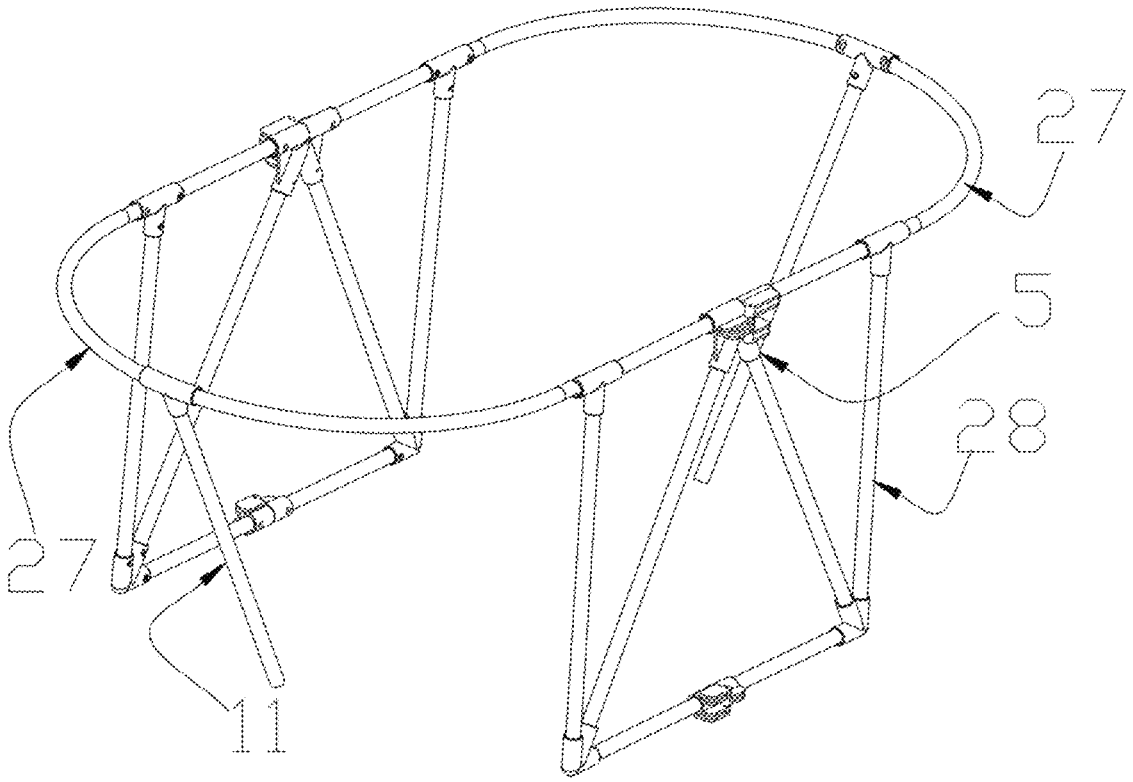
FIG. 17 is a first process diagram showing a first folding way of the present disclosure.
Figure 18:
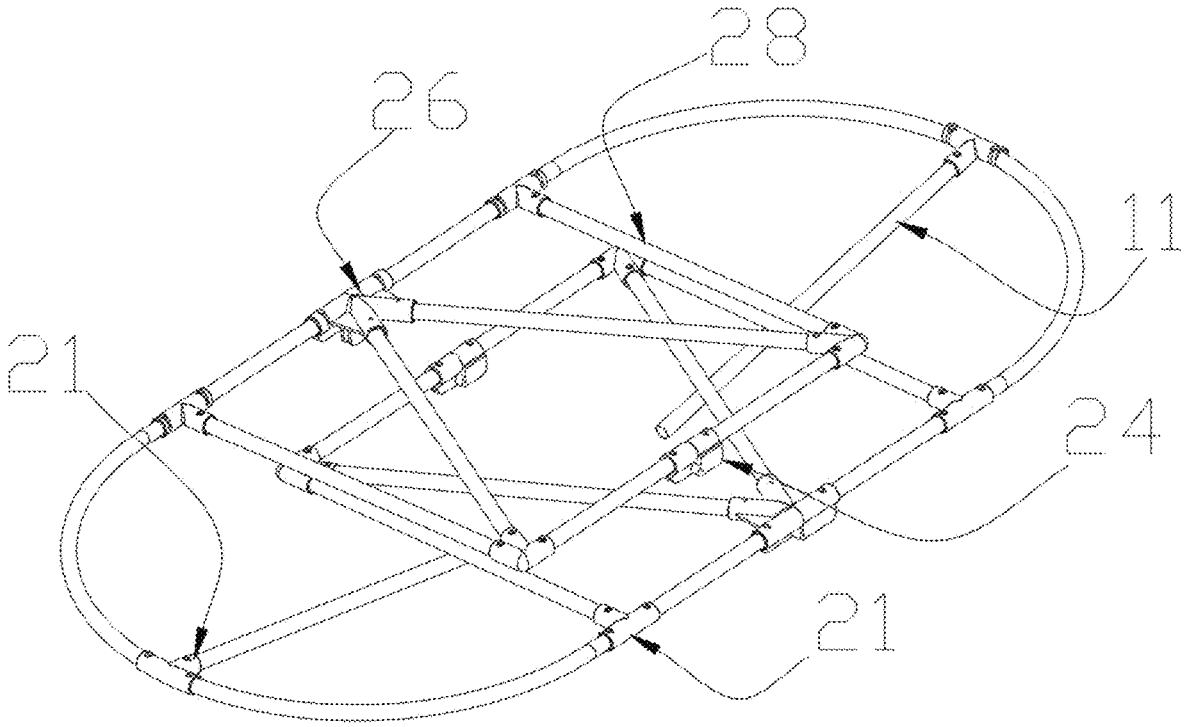
FIG. 18 is a second diagram showing of the first folding way of the present disclosure.
Figure 19:
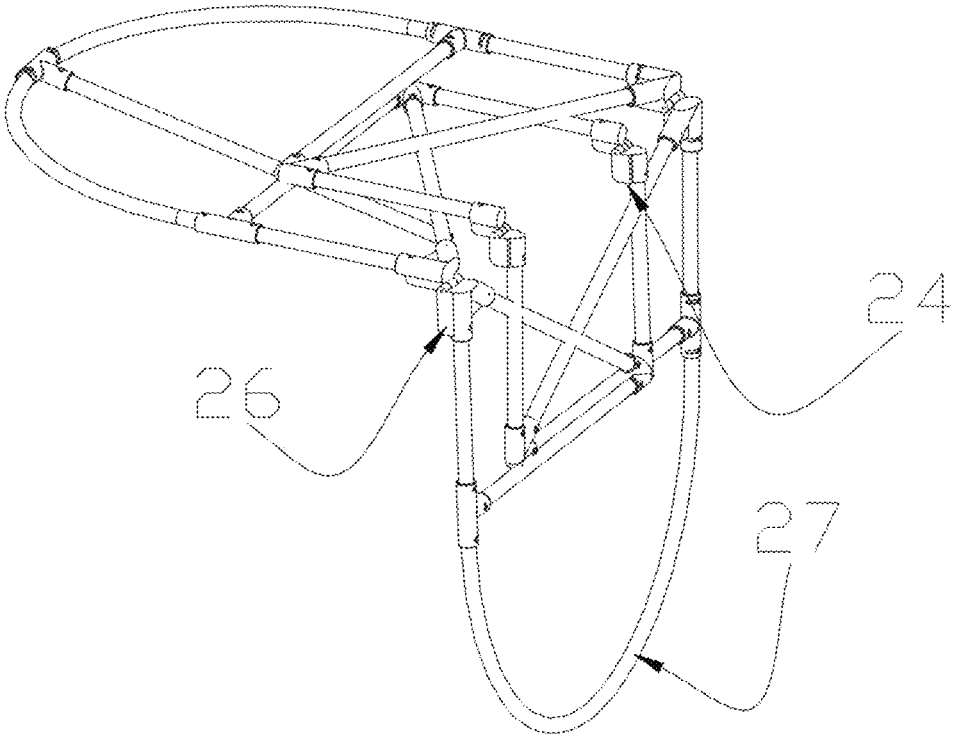
FIG. 19 is a third process diagram of the first folding way of the present disclosure.
Figure 20:
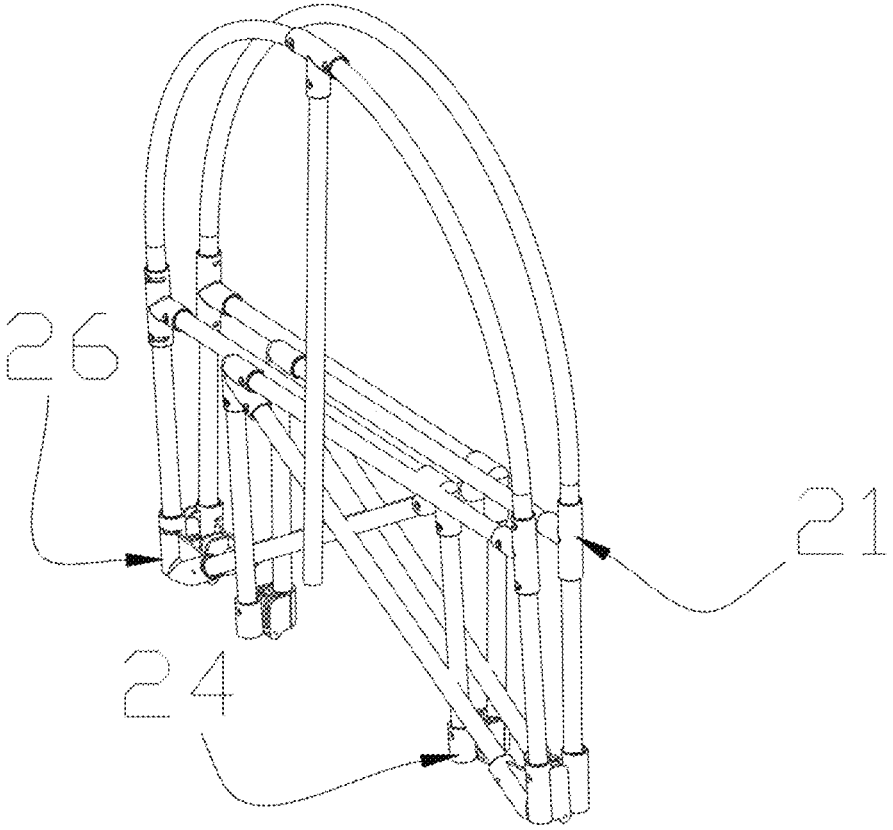
FIG. 20 is a state diagram of the first folding way after being folded of the present disclosure.

As shown in FIG. 17; the shaping frame 3 is formed by placing an arc-shaped rod 27 and a straight rod 28 into the connector 5. The connector 5 can be adjusted according to needs and folded for storage through different schemes. There are two arc-shaped rods 27, and they are provided on two sides of the straight rod 28, rendering a barrel mouth being long waist shaped. The supporting frame 4 is formed by placing a plurality of straight rods 28 into the connector 5. According to whether the supporting frame 4 has the folding effect, an appropriate connector 5 is selected for combination. The straight rods 28 on an outside of the supporting frame 4 form a shape of "⊔". The two straight rods 28 in the supporting frame 4 are inclined to each other so as to form a triangular structure. Bottom ends of the two side support rods 11 are inclined inwardly, that is, an outer periphery of the supporting frame 4 is in a shape of "⊔", thereby forming a rectangular structure with the straight rod at the middle of the shaping frame 3. By placing two inclined straight rods 28, a triangular structure with three common sides is formed in the supporting frame.

As shown in FIGS. 17 to 20; a two-fold storage solution is provided, and the supporting frame 4 can also be folded. The middle of the shaping frame 3 is provided with the disc-shaped flipping head 26, two sides of the disc-shaped flipping head 26 are connected with the straight rod 28. One end of the straight rod 28 away from the disc-shaped flipping head 26 is connected to the arc-shaped rod 27 through the T-shaped joint 21, thereby forming the shaping frame 3. The middle of the arc-shaped rod 27 is provided with the T-shaped joint 21 that is connected to the side support rod 11. The T-shaped joint 21 is arc-shaped and has the same curvature as the arc-shaped rod 27. The straight flipping head 24 is provided at a lower end of the supporting frame 4 and a corresponding position of the disc-shaped flipping head 26, so that the supporting frame 4 can also be folded.

Where the arc-shaped groove 15 is provided at upper ends of the disc-shaped flipping head 26 and the T-shaped joint 21, and the remaining limiting grooves are all hole grooves 14;

the arc-shaped groove 15 provided on an upper end of the disc-shaped flipping head 26 allows it to be rotated on the shaping frame 3, thereby driving the supporting frame 4 to fold;

the T-shaped joint 21 can be rotated on the arc-shaped rod 27 through providing the arc-shaped groove 15 at two ends, and the side support rod 11 is driven to rotate; the arc-shaped rod 27 should be provided with the protruding column 13 for fixing the T-shaped joint 21;

a specific folding step is as follows: first, one side of the supporting frame 4 is pushed inwardly to break the usage state of the bathtub body 1 and in the storage state. When pushing in the supporting frame 4, the disc-shaped flipping head 26 and the T-shaped joint 21 are rotated around the straight rod 28 connected to the middle of the shaping frame 3. When one side of the supporting frame 4 is rotated (folded) beyond the centerline of the shaping frame 3, the other side of the supporting frame 4 can be pushed to compress a first folded supporting frame 4 and close to the shaping frame. When the supporting frames 4 at two sides are completed a folding work, the bathtub body 1 is in the blocky structure, and the disc-shaped flipping head 26 is adjacent to the straight flipping head 24. Folding directions of the two are the same. The arc-shaped rod 27 on one side of the bathtub body 1 in blocky structure is lift, and the disc-shaped flipping head 26 and the straight flipping head 24 are caused to be folded together, thereby realizing a second folding of the bathtub body 1.

Figure 21:
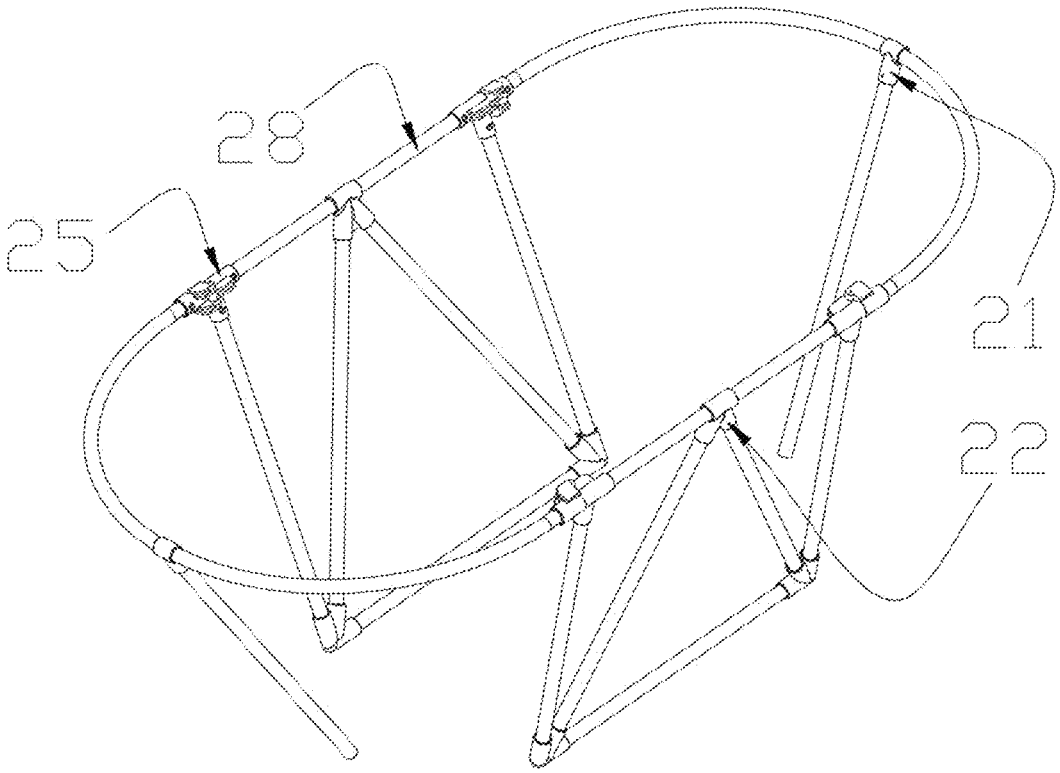
FIG. 21 is a first process diagram showing a second folding way of the present disclosure.
Figure 22:
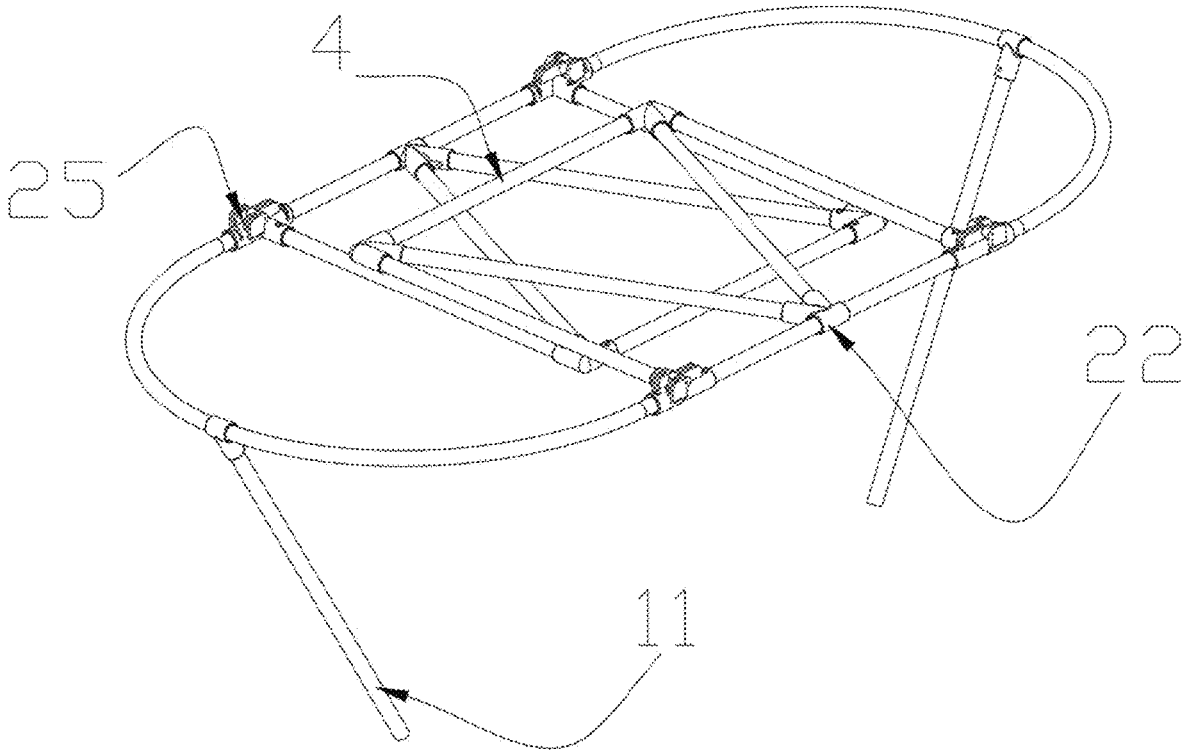
FIG. 22 is a second process diagram showing the second folding way of the present disclosure.
Figure 23:
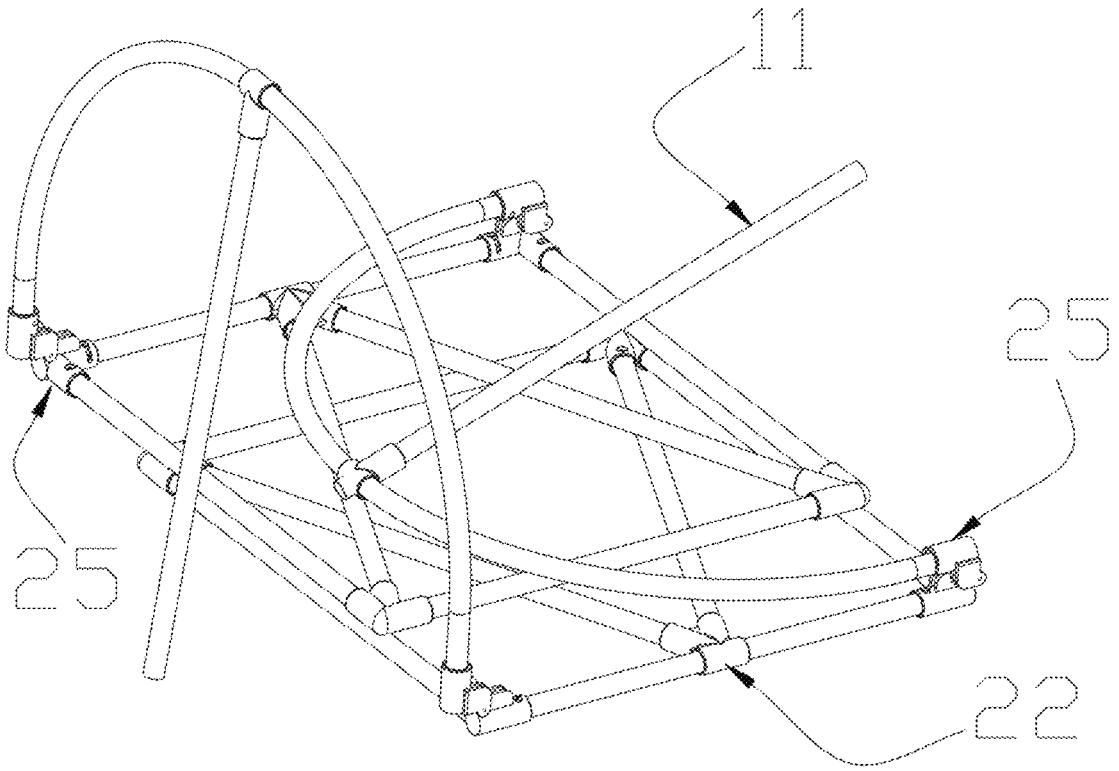
FIG. 23 is a state diagram of the second folding way after being folded of the present disclosure.
Figure 24:
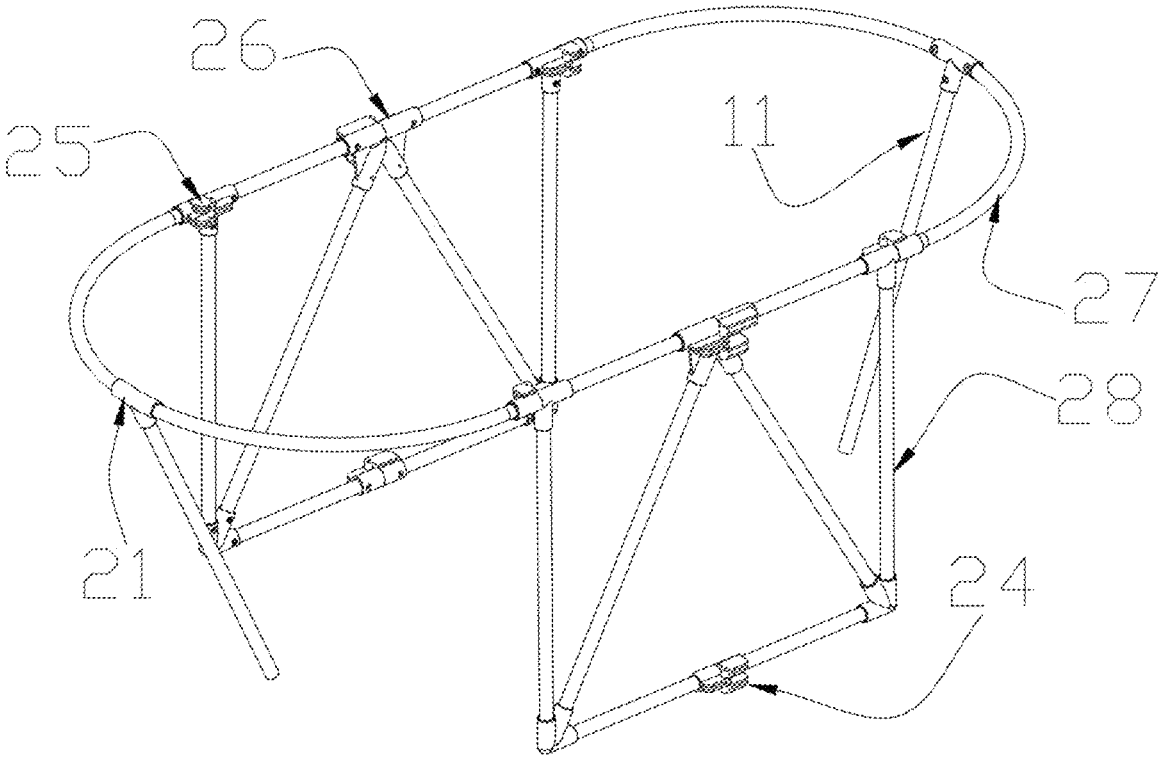
FIG. 24 is a first process diagram showing a third folding way of the present disclosure.
Figure 25:
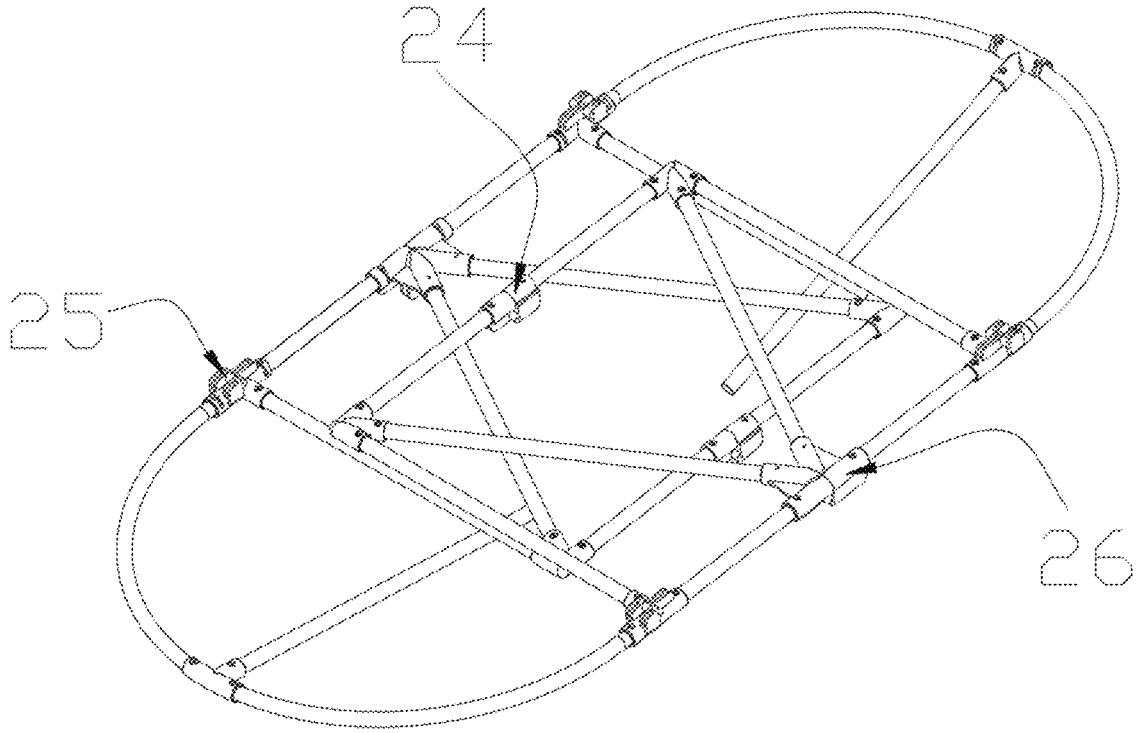
FIG. 25 is a second process diagram showing the third folding way of the present disclosure.
Figure 26:
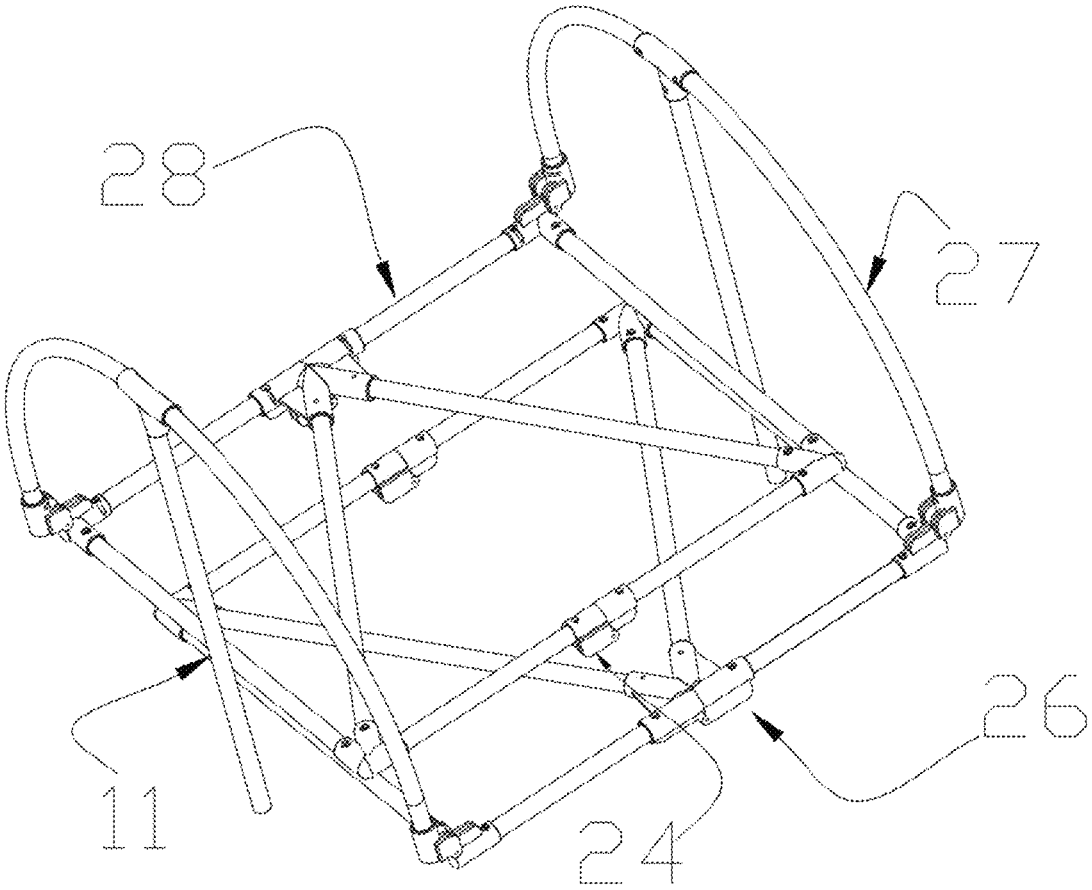
FIG. 26 is a third process diagram showing the third folding way of the present disclosure.
Figure 27:
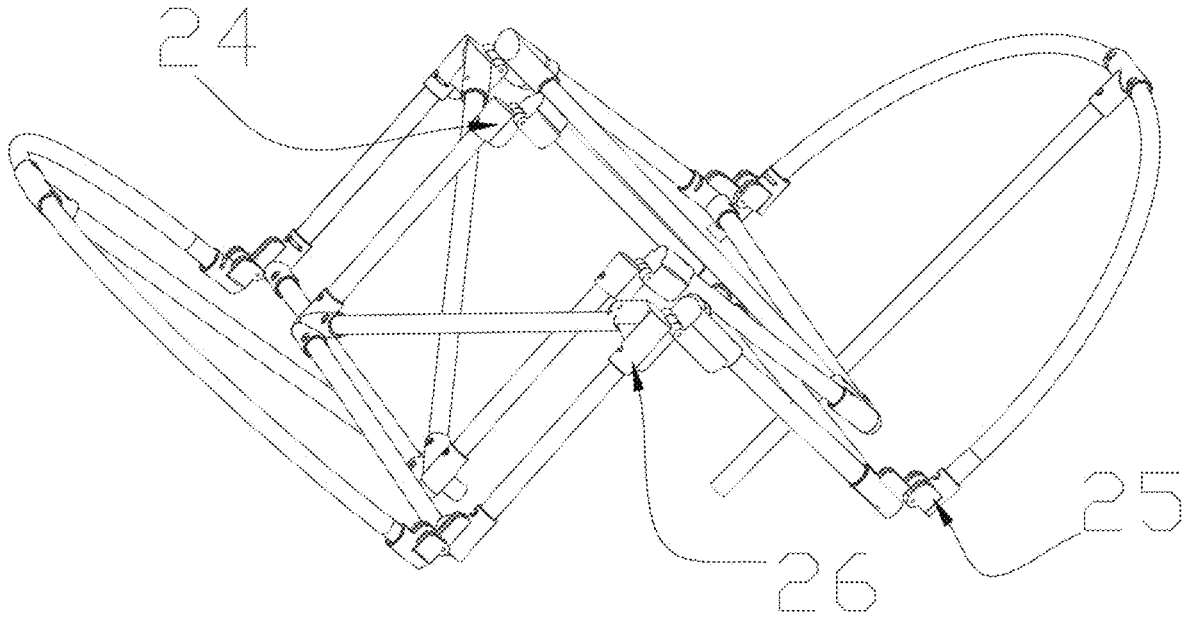
FIG. 27 is a fourth process diagram showing the third folding way of the present disclosure.
Figure 28:
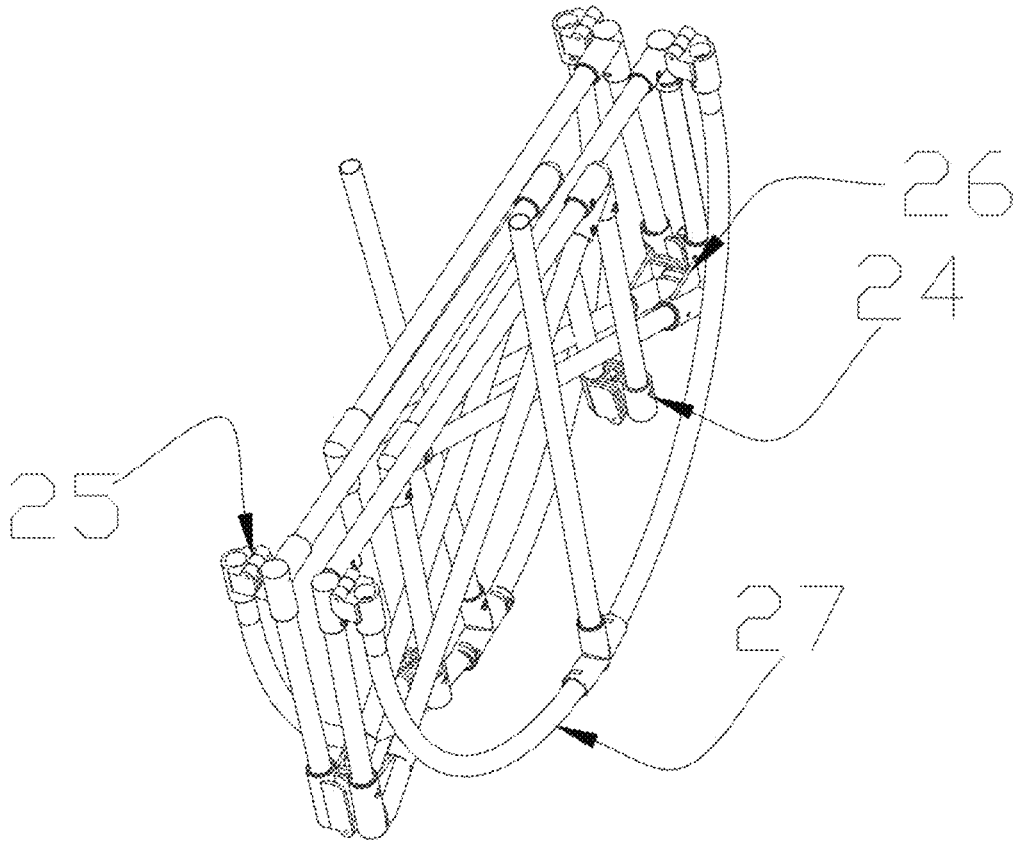
FIG. 28 is a state diagram of the third folding way after being folded of the present disclosure.

As shown in FIGS. 21 to 23; the present application further provides a double folding storage solution, and the supporting frame 4 cannot be folded;

where the butterfly-shaped joints 22 are symmetrically provided in the middle of the shaping frame 3, so that the middle of the shaping frame 3 does not have the folding effect; two sides of the butterfly-shaped joint 22 are connected with the straight rod 28; one end of the straight rod 28 away from the butterfly-shaped joint 22 is connected to the arc-shaped rod 27 through the T-shaped flipping head 25; the arc-shaped rod 27 can be folded inwardly for storage through the T-shaped flipping head 25; the middle of the arc-shaped rod 27 is provided with the T-shaped joint 21 that is connected to the side support rod 11;

where the arc-shaped groove 15 is provided at upper ends of the butterfly-shaped joint 22, the T-shaped flipping head 25, and the T-shaped joint 21, and the remaining limiting grooves are all hole grooves 14.

An upper end of the butterfly-shaped joint 22 is provided with the arc-shaped groove 15, which allows it to be rotated around the straight rod 28 that is connected to the shaping frame 3, and the supporting frame 4 is driven to be flipped inwardly;

the T-shaped flipping head 25 is provided with the arc-shaped grooves 15 on two sides, allowing it to be rotated around the arc-shaped rod 27 that is connected to the straight rod 28 on the shaping frame 3;

the T-shaped joint 21 can be rotated on the arc-shaped rod 27 by providing the arc-shaped grooves 15 at two ends, and the side support rod 11 is driven to be rotated (folded); the arc-shaped rod 27 should be provided with the protruding column 13 for fixing the T-shaped joint 21;

a specific folding step is as follows: first, one side of the supporting frame 4 is pushed inwardly to break the usage state of the bathtub body 1 and in the storage state. When pushing in the supporting frame 4, the butterfly-shaped joint 22 and the T-shaped flipping head 25 are rotated around the straight rod 28 connected to the middle of the shaping frame 3. When one side of the supporting frame 4 is rotated (folded) beyond the centerline of the shaping frame 3, the other side of the supporting frame 4 can be pushed to compress the first folded supporting frame 4 and close to the shaping frame. When both sides of the supporting frame 4 are completed the folding work, the bathtub body 1 is in the blocky structure. At this time, an opening of the folding piece provided on the T-shaped flipping head 25 is facing downwards, that is, the arc-shaped rod 27 can be folded upward through the T-shaped flipping head 25. At this time, the middle of the shaping frame 3 can be hold with hands, the side support rod 11 is opened outwardly, and the bathtub body 1 in blocky structure is pressed downwardly to render the two side support rods 11 to be contact the ground, the two support rods 11 are pushed up through the ground and the two arc-shaped rods 27 are pushed up simultaneously by the two support robs 11. At this time, one side of the arc-shaped rod 27 is first folded onto the shaping frame 3 and the support rod 11 is adjusted to be in the folded state with the arc-shaped rod 27 that is connected with. Then the above steps are repeated on the other side, or the bathtub body 1 is placed on one side, an angle of the side support rod 11 is adjusted by hand, and finally the arc-shaped rod 27 is folded to complete the storage.

As shown in FIGS. 24 to 28; the present application further provides a tri-folding storage solution, and the supporting frame 4 can be folded;

the disc-shaped flipping heads 26 are symmetrically provided at the middle of the shaping frame 3, which can be rotated and folded at the middle thereof, two sides of the disc-shaped flipping head 26 are provided with the straight rod 28; one end of the straight rod 28 away from the disc-shaped flipping head 26 is connected to the arc-shaped rod 27 through the T-shaped flipping head 25; at this position, the supporting frame 4 can be caused to be flipped and render the arc-shaped rod 27 have an ability being folded; a middle of the arc-shaped rod 27 is provided with the T-shaped joint 21 connecting the side support rod 11, and the T-shaped flipping head 24 is provided at a lower end of the supporting frame 4 and a corresponding position of the disc-shaped flipping head 25, a folding can occur at this position;

where the arc-shaped groove 15 is provided at upper ends of the disc-shaped flipping head 26, the T-shaped flipping head 25, and the T-shaped joint 21, and the remaining limiting grooves are all hole grooves 14.

the arc-shaped groove 15 provided on the upper end of the disc-shaped flipping head 26 allows it to be rotated on the shaping frame 3, thereby driving the supporting frame 4 to be folded;

the arc-shaped groove 15 provided on the T-shaped flipping head 25 allows it to be rotated on the shaping frame 3 and enables the arc-shaped rod 27 connected to it to have the folding ability;

the T-shaped joint 21 can be rotated on the arc-shaped rod 27 by providing with the arc-shaped grooves 15 at two ends, and thereby driving the side support rod 11 to be rotated (folded); the arc-shaped rod 27 should be provided with the protruding column 13 for fixing the T-shaped joint 21;

a specific folding step is as following:

a first folding process is that one side of the supporting frame 4 is pushed inwardly to break the usage state of the bathtub body 1, and in the storage state; when pushing in the supporting frame 4, the disc-shaped flipping head 26 and the T-shaped joint 21 are rotated around the straight rod 28 connected to the middle of the shaping frame 3; when one side of the supporting frame 4 is rotated (folded) beyond the centerline of the shaping frame 3, the other side of the supporting frame 4 can be pushed to compress the first folded supporting frame 4 and close to the shaping frame;

after the supporting frames 4 on two sides have completed the folding work, the bathtub body 1 is in the blocky structure, and the first folding is completed; at this time, the folding piece provided on the T-shaped flipping head 25 is facing upwards, and the disc-shaped flipping head 26 is adjacent to the straight flipping head 24;

a second folding process is that the arc-shaped rod 27 can be folded upwards through the T-shaped flipping head 25; at this time, the two arc-shaped rods 27 can be folded and placed on the shaping frame 3, and the position of the side support rod 11 can be adjusted to complete the second folding;

a third folding process is that the middle of the shaping frame 3 is hold with two hands, and the shaping frame 3 is naturally bend downwards under gravity, that is, the disc-shaped flipping head 26 and the straight flipping head 24 are naturally opened under gravity, and then a bottom surface of the shaping frame 3 is pushed along and attached to a folding line formed by the disc-shaped flipping head 26 and the straight flipping head 24 with hand;

or, in step of the second folding, it should not be flipped completely, the middle of the shaping frame 3 is hold when the arc-shaped rod 27 in an inclined state, thereby a W-shaped connection between the two arc-shaped rods 27 and a bend shaping frame 3 is formed. Then, the two arc-shaped rods 27 on two sides can be pressed inwardly to complete the folding process.

Figure 29:
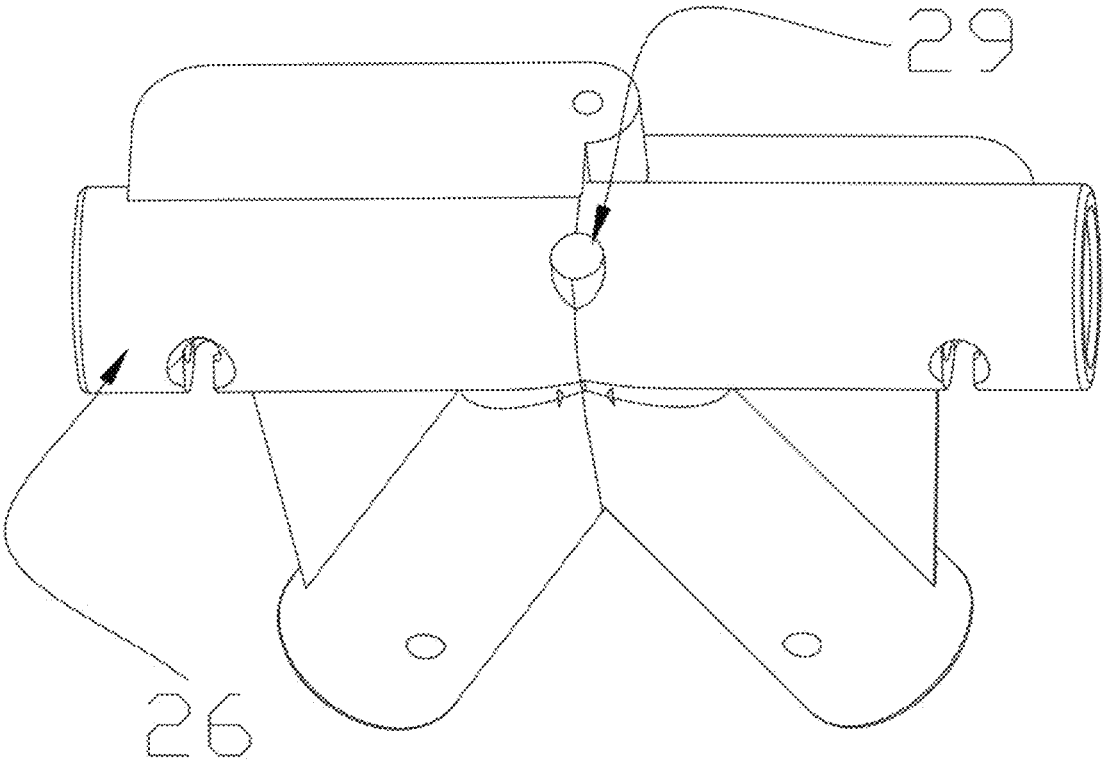
FIG. 29 is a first schematic structural diagram of a reinforcing rib of the present disclosure.
Figure 30:
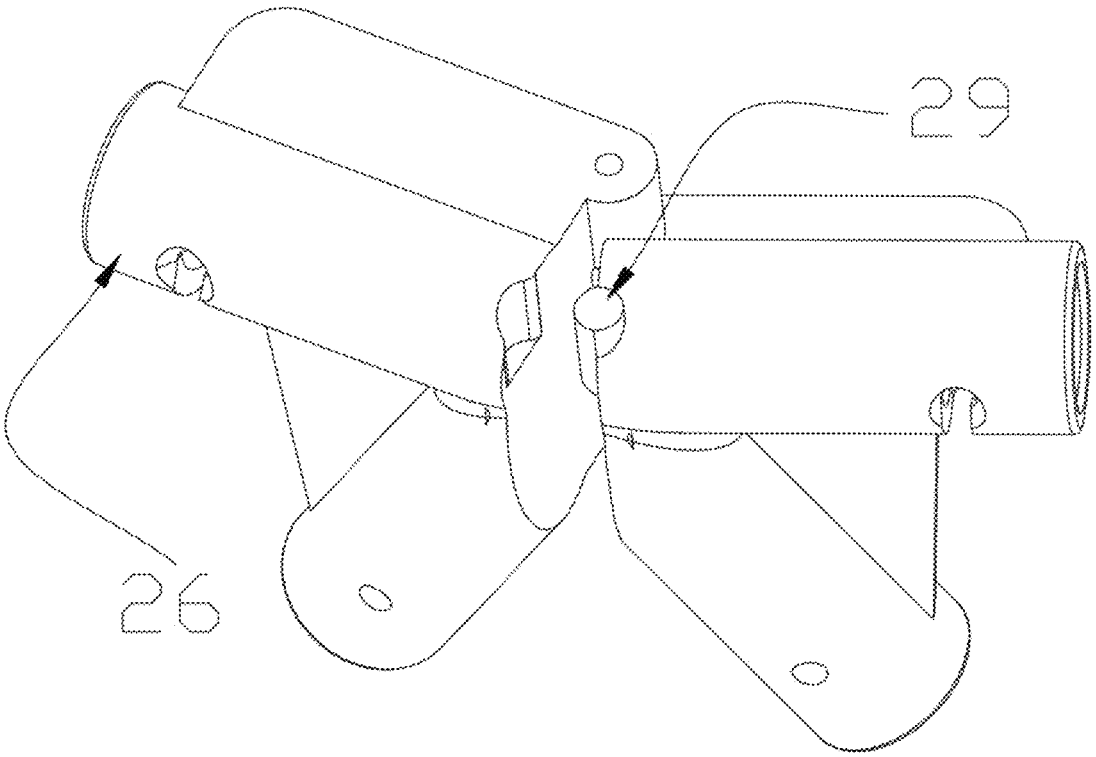
FIG. 30 is a second schematic structural diagram of the reinforcing rib of the present disclosure.

As shown in FIGS. 29 and 30, a reinforcement rib 29 is provided between the two connection rod seats 16 provided on the straight flipping head 24, the T-shaped flipping head 25, and the disc-shaped flipping head 26. The reinforcement rib 29 is a protruding rib and a concave rib, respectively provided on the connection rod seats 16 on different sides. When the connection rod seats 16 are in a straight state, the protruding rib is embedded in the concave rib and the surface is smooth.

Working principle: the bathtub body 1 is formed by the soft packaging layer 2 supported by the shaping frame 3 and the supporting frame 4 through the connector 5. The shaping frame 3 and the supporting frame 4 are consisted by different styles of fixed joints and foldable joints. The shaping frame 3 and the supporting frame 4 may have multiple rotating, folding or having function of being rotating and folding at the same time. The user can decompose the bathtub body 1 from the barrel-shaped structure into the blocky structure through reasonable and limited steps, which is convenient for storage. When in use, he only needs to reverse the decomposition steps to reactivate the bathtub body 1. The rotation effect is achieved through a cooperation of the arc-shaped groove 15 and the protruding column 13. The arc-shaped groove 15 is a movement path of the protruding column 13. The folding is achieved through a cooperation of the embedding piece 18 and the clamping piece 19, allowing the support rods connected at two ends of the two can be folded, thereby enabling the shaping frame 3 and the supporting frame 4 has the folding effect.

The above embodiments only express some embodiments of the present disclosure, and the descriptions are more specific and detailed, but should not be understood as limiting the scope of the present disclosure. It should be pointed out that for those skilled in the art, several modifications and improvements can be made without departing from the inventive concept, which are within the protection scope of the present disclosure. Therefore, the protection scope of the present disclosure patent should be based on the appended claims.

What is claimed is:

1. A foldable bathtub, comprising a bathtub body, wherein the bathtub body is provided with a soft packaging layer and a barrel supporting member, the soft packaging layer is connected to the barrel supporting member;

the barrel supporting member is capable of being supported by the soft packaging layer to form a barrel-shaped structure when it is in an unfolded state;

when the barrel supporting member is changed from the unfolded state to a folded state, it can be folded together with the soft packaging layer to render the soft packaging layer being changed from the barrel-shaped structure to a blocky structure;

the barrel supporting member is consisted of a shaping frame and a supporting frame; the shaping frame is connected to the supporting frame by a connector; both the shaping frame and the supporting frame are formed by splicing with a support rod and the connector;

the connector is capable of being rotated on the shaping frame, that is, the supporting frame can be flipped by changing an angle between it with the shaping frame through the connector; a limit piece is provided between the connector and the support rod, and the limit piece is configured to prevent the connector from being detached from the support rod during rotation or moving;

the connector comprises a fixed joint and a foldable joint;

at least one pair of foldable joints are provided at a connection between the shaping frame and the supporting frame, thereby allowing the shaping frame to be folded;

the supporting frame is provided with an inclined support rod, thereby forming a triangular structure within the supporting frame;

wherein the supporting frame is capable of cooperating with the support rod through the foldable joint and the fixed joint to form the supporting frame with a folding effect.

2. The foldable bathtub according to claim 1, wherein a top of the soft packaging layer is provided with an inflatable ring, an outermost layer of the soft packaging layer is a shaping layer, an innermost layer of the soft packaging layer that is contacted with a human body is a waterproof layer; a thermal insulation layer is provided between the shaping layer and the waterproof layer, the soft packaging layer is protruded from the shaping frame, and a protruding portion of the soft packaging layer is capable of being flipped outwardly to cover the shaping frame and form a sleeve that is capable of being sleeved into the shaping frame;

wherein the shaping layer is further provided with a tightening rod layer configured for a side support rod to penetrate;

upper and lower ends of the tightening rod layer are provided with an insertion hole, the side support rod is connected to the shaping frame after penetrating the tightening rod layer.

3. The foldable bathtub according to claim 2, wherein the limit piece is composed of a protruding column and a limiting groove, the protruding column is provided on the support rod, a bottom of the protruding column is provided with a spring, the spring renders the protruding column to be protruded from the support rod when not subjected to an external force, wherein the limiting groove comprises a hole groove and an arc-shaped groove, the hole groove is capable of fastening the support rod to render it have no deviate, and the arc-shaped groove is configured to prevent the support rod from being detached from the connector, and the arc-shaped groove is a space to avoid the protruding column when the connector and the support rod are rotated;

a side wall of the limiting groove is inclined outwardly.

4. The foldable bathtub according to claim 3, wherein the foldable joint is composed of two connection rod seats connected by a folding piece, each of the two connection rod seats is provided with at least one limiting groove and one rod inlet;

the folding piece is provided with an embedding piece and a clamping piece, the embedding piece and the clamping piece are provided with connection holes that are located on the same straight line;

the embedding piece is capable of being inserted into the clamping piece, when the embedding piece is provided on one of the two connection rod seats, the clamping piece is provided on the other one of the two connection rod seats.

5. The foldable bathtub according to claim 4, wherein the fixed joint comprises a T-shaped joint, a butterfly-shaped joint, and an angled joint, all of which are provided with at least two rod inlets and at least two limiting grooves;

the T-shaped joint and the butterfly-shaped joint are provided on the shaping frame to form the shaping frame, the rod inlet is provided at lower ends of the T-shaped joint and the butterfly-shaped joint and is configured to connect the side support rod or the supporting frame;

an angle between the rod inlets that are provided on the angled joint is smaller than 30°.

6. The foldable bathtub according to claim 5, wherein the foldable joint comprises a straight flipping head, a T-shaped flipping head, and a disc-shaped flipping head;

the straight flipping head is provided with two rod inlets located on the same straight line;

the T-shaped flipping head has the same appearance as the T-shaped joint, the flipping piece is offset to one side so as to avoid the rod inlet located below;

the disc-shaped flipping head has the same appearance as the butterfly-shaped joint, and the flipping piece is provided in a middle of the disc-shaped flipping head;

lower ends of the disc-shaped flipping head and the butterfly-shaped joint are both provided with a reinforcing rib in block-shaped.

7. The foldable bathtub according to claim 6, wherein the shaping frame is formed by inserting an arc-shaped rod and a straight rod into the connector, there are two arc-shaped rods, and they are provided on two sides of the straight rod, the supporting frame is formed by placing a plurality of straight rods into the connector, the straight rods on an outer side of the supporting frame form a shape of "⊔", two straight rods in the supporting frame are inclined to each other so as to form a triangular structure, bottom ends of the two side support rods are tilted inwardly, a reinforcement rib is provided between the two connection rod seats that are provided on the straight flipping head, the T-shaped flipping head, and the disc-shaped flipping head.

8. The foldable bathtub according to claim 7, wherein the disc-shaped flipping head is provided in a middle of the shaping frame, two sides of the disc-shaped flipping head are both connected with the straight rod;

one end of the straight rod away from the disc-shaped flipping head is connected to the arc-shaped rod through the T-shaped joint, the T-shaped joint connecting the side support rod is provided in a middle of the arc-shaped rod;

the straight flipping head is further provided at a lower end of the supporting frame and a corresponding position of the disc-shaped flipping head;

wherein the arc-shaped groove is provided at upper ends of the disc-shaped flipping head and the T-shaped joint.

9. The foldable bathtub according to claim 7, wherein the butterfly-shaped joints are symmetrically provided in a middle of the shaping frame, the straight rod is provided on two sides of the butterfly-shaped joint;

one end of the straight rod away from the butterfly-shaped joint is connected to the arc-shaped rod through the T-shaped flipping head, the T-shaped joint connecting the side support rod is provided in a middle of the arc-shaped rod;

wherein the arc-shaped groove is provided at upper ends of the butterfly-shaped joint, the T-shaped flipping head, and the T-shaped joint.

10. The foldable bathtub according to claim 7, wherein the disc-shaped flipping heads are symmetrically provided in a middle of the shaping frame, the straight rod is provided at two sides of the disc-shaped flipping head;

one end of the straight rod away from the disc-shaped flipping head is connected to the arc-shaped rod through the T-shaped flipping head;

the T-shaped joint connecting the side support rod is provided in a middle of the arc-shaped rod;

the straight flipping head is further provided at a lower end of the supporting frame and a corresponding position of the disc-shaped flipping head;

wherein the arc-shaped groove is provided at upper ends of the disc-shaped flipping head, the T-shaped flipping head, and the T-shaped joint.

* * * * *